US006317149B1

(12) United States Patent
Mochida et al.

(10) Patent No.: US 6,317,149 B1
(45) **Date of Patent: *Nov. 13, 2001**

(54) LAMINATION TRANSFER OBJECT PRODUCING APPARATUS AND METHOD

(75) Inventors: Yasuhiko Mochida, Numazu; Mitsuharu Endo, Susono, both of (JP)

(73) Assignee: Toshiba Tec Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 58 days.

(21) Appl. No.: 09/085,886

(22) Filed: May 27, 1998

(30) Foreign Application Priority Data

May 29, 1997 (JP) ..... 9-139813

(51) Int. Cl.[7] ..... B41J 2/325
(52) U.S. Cl. ..... 347/173; 347/212; 347/176
(58) Field of Search ..... 347/212, 176, 347/173; 400/120.18

(56) References Cited

U.S. PATENT DOCUMENTS 4,012,552 3/1977 Watts .
4,527,171 * 7/1985 Takanashi et al. ..... 347/212
4,704,615 * 11/1987 Tanaka ..... 347/212

FOREIGN PATENT DOCUMENTS

0191592 A2 8/1986 (EP) .
0487724 A1 6/1992 (EP) .
0700791 A1 3/1996 (EP) .
2697466 5/1994 (FR) .

OTHER PUBLICATIONS

Patent Abstracts of Japan, vol. 011, No. 199 (M–602), Jun. 26, 1987 & JP 62 021585 A (Kowa Sangyo KK), Jan. 29, 1987.

* cited by examiner

*Primary Examiner*—Huan Tran
(74) *Attorney, Agent, or Firm*—Frishauf, Holtz, Goodman, Langer & Chick, P.C.

(57) ABSTRACT

A thermal printer is comprised of a head section for applying heat with pressure to a transfer film having a metal foil, arranged to cover an ink layer of a desired pattern formed on print paper, and removed to transfer the metal foil toward the print paper, and a controller for controlling the head section such that the transfer film is heated with a heating pattern larger than the pattern of the ink layer by at least a margin for positional displacement between the ink layer and the head section, so as to obtain a lamination transfer object in which a contour of the metal foil is aligned with that of the ink layer by an adhesive force between the metal foil and the ink layer.

41 Claims, 9 Drawing Sheets

LAMINATION TRANSFER OBJECT PRODUCING APPARATUS AND METHOD

BACKGROUND OF THE INVENTION

The present invention relates to a lamination transfer object producing apparatus and method in which a specific material layer is transferred to a transfer target object under heat and pressure, and particularly to a lamination transfer object producing apparatus and method in which a transfer underlayer is placed between the specific material layer and the transfer target object to control an adhesive force therebetween.

A metal foil is used to fabricate an electromagnetic circuitry such as an antenna on a shoplift protecting radio tag or conferring glossiness on a label or seal affixed to a vessel, paper, or the like. The metal foil is adhered to a transfer target material such as the radio tag, label, and seal by sticking or hot stamping. In hot stamping, the metal foil is hot-pressed on the transfer target object with a transfer underlayer by means of a metal die.

Conventional hot stamping will be described with reference to FIG. 19. This hot stamping is performed by using a press table for receiving a stack of a transfer target object and a transfer film, and a hot metal die for pressing the transfer film onto the transfer target object. The transfer film is formed of a metal foil and a base film which supports the metal foil, and the transfer target object is covered with a transfer underlayer of good adhesiveness to the metal foil. The metal foil on the base film is adhered to the transfer target object by heat and pressure applied by the metal die. This adhesive force is stronger than that to the base film. The metal foil is separated from the base film and retained on the transfer target object when the transfer film is removed after the metal die. In this way, a lamination transfer object is formed of the metal foil and the transfer target object.

In the hot stamping, the transfer target object is generally coat paper which is coated with resin to form the adhesive transfer underlayer. In the case where the transfer target object is a resin sheet, a surface treatment is given on the surface of the sheet to attain adhesiveness with the specific material layer.

The Jpn. Pat. Appln. KOKAI Publication No. 8-336947 discloses a transport apparatus has been contrived to correct a positional displacement between the metal die and the transfer target object. The Jpn. Pat. Appln. KOKAI Publication No. 6-122184 discloses a technique of producing a lamination transfer object without using a process of hot stamping. In this technique, an intermediate transfer medium is used transfer to eliminate a positional displacement. In both cases, positional displacement cannot be fully eliminated. In addition, there is a patterning process performed to attain a lamination transfer object with a high precision pattern. In this process, a specific material layer made of a metal foil is patterned in advance on a transfer film, for example, by etching.

As mentioned above, in hot stamping with a die, there are problems on apparatus and running costs. Besides, a problem of a floor space arises as in the case of a press machine and learning of a technique is also required. Furthermore, an etching process has similar problems.

BRIEF SUMMARY OF THE INVENTION

It is, in light of the above mentioned problems, objects of the present invention to provide a lamination transfer object producing apparatus and method which can transfer a specific material layer made of metal or ink to a transfer target object in high positional precision without a die nor a form plate.

According to the present invention, there is provided a lamination transfer object producing apparatus which comprises a variable area heating unit for applying heat with pressure to a transfer film having a specific material layer, arranged to cover a transfer underlayer of a desired pattern formed on a transfer target object, and removed to transfer the specific material layer toward the transfer target object; and a controller for controlling the variable area heating unit such that the transfer film is heated with a heating pattern larger than the pattern of the transfer underlayer by at least a margin for positional displacement between the transfer underlayer and the variable area heating unit, so as to obtain a lamination transfer object in which a contour of the specific material layer is aligned with that of the transfer underlayer by an adhesive force between the specific material layer and the transfer underlayer.

According to the present invention, there is also provided a lamination transfer object producing method which comprises a step of applying heat with pressure by a variable area heating unit to a transfer film having a specific material layer, arranged to cover a transfer underlayer of a desired pattern formed on a transfer target object, and removed to transfer the specific material layer toward the transfer target object; and a step of controlling the variable area heating unit such that the transfer film is heated with a heating pattern larger than the pattern of the transfer underlayer by at least a margin for positional displacement between the transfer underlayer and the variable area heating unit, so as to obtain a lamination transfer object in which a contour of the specific material layer is aligned with that of the transfer underlayer by an adhesive force between the specific material layer and the transfer underlayer.

With the lamination transfer object producing apparatus and method, the variable area heating unit is used instead of a die or form plate so as to obtain a lamination transfer object in which the specific material layer such as a metal foil is transferred to the transfer target object in a desired pattern determined on demand. There is no special technique to be learned by an operator. Further, the heating pattern of the transfer film is set larger by at least a margin for a positional displacement between the variable area heating unit and the transfer underlayer. Therefore, the specific material layer can be shaped in the desired pattern according to the transfer underlayer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Since the present application is directed toward fabrication of a lamination transfer object which a specific material layer such as a metal foil or the like is transferred onto a transfer target object and shaped in a desired pattern under application of head and pressure on demand without using a die nor a form plate and a special technique to be learned, a thermal printer will be exemplified as a transfer machine. A monochrome printer will not be exemplified but a color printer will be. While even with a monochrome printer, a transfer operation may sufficiently be repeated in several times, since it is close to learning an specialized technique, the case where a color thermal printer is adopted will be described as a transfer machine, which can perform a transfer under application of heat and pressure, and in which exchanges of films and inks are performed without requirement for special technique like a current printer with use of, for example an ink cartridge. It is needless to say that a printer can be taken up, in which an ink cartridge is automatically recognized, and which a user can operate as a black box, but here is adopted a color thermal printer called a tandem type which has a transfer unit for each transfer process since it is easy to understand. In the following descriptions, examples are described where a print matter is a main thing of a lamination transfer object. Accordingly, ink is a main thing as a laminating material.

Figure 1:
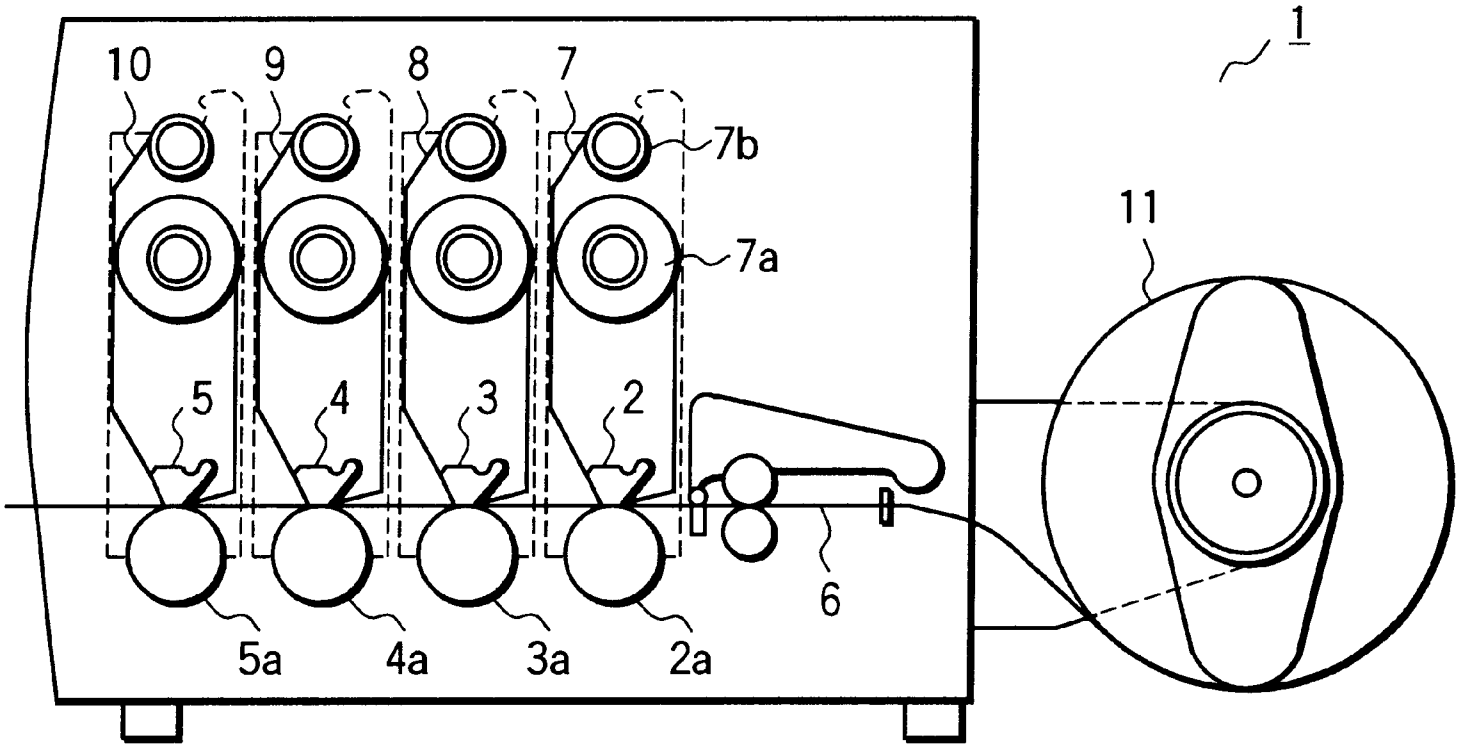
FIG. 1 is a side view showing a structure of a color thermal printer according to an embodiment of the present invention.

FIG. 1 is a side view showing a structure of a color thermal printer 1 as a lamination transfer machine used in this embodiment. In FIG. 1, the thermal printer includes 4 thermal heads 2, 3, 4, 5 in which arbitrary kinds of transfer films such as ink ribbons are provided on a feed rolls 7*a*, 8*a*, 9*a*, 10*a*. As an example of a transfer target object, a print paper 11 is provided in the form of a roll located behind the printer and supplied to the printer at a feed rate of 4 in/sec (about 10 cm/sec) from the right side in FIG. 1. The thermal heads 2, 3, 4, 5 are associated with platens 2*a*, 3*a*, 4*a*, 5*a* to applies pressure to the transfer films and the print paper 11 which are interposed therebetween and driven at predetermined set timings. The transfer films are respectively wound on take-up rolls 7*b*, 8*b*, 9*b*, 10*b* as the print paper 11 moves. In this way, the thermal printer produces a color print matter having parts of the transfer films sequentially transferred onto the paper 11 and serving as a lamination transfer object. A color is a part of optical properties, thus the lamination transfer object can be produced as an optical component combined with other components such as mirrors or diffraction gratings. In an ordinary color printing, a desired color is created by a combination of four coloring inks which includes three primary colors yellow Y, magenta M, and cyan C in addition to black K. For example, when a red letter is printed, a desired letter of magenta is first printed, followed by printing in magenta superposed in absolutely the same place of the letter to create a red color. If there arises a positional displacement, letters in yellow and magenta M are seen separately or as a blurred letter. Though it is natural, an ink with a good transmittance is used in order to create a color by superposition. A color printing is performed in such a manner as mentioned above. If a decorative color such as gold or silver is required, any of the transfer films can be replaced with an ink ribbon made of ink containing metal powder. For example, after printing in yellow Y, magenta M, and cyan C is conducted by the heads 2, 3, 4, printing in gold or silver can be conducted by the remaining head 5. Since ink containing metal powder does not have much of a metallic glossiness and rather has a dull and dark color, it is recommended to use a metal foil in order to obtain a lamination transfer object having an optical property of glossiness. An electrical resistance of the lamination transfer object can be reduced by some extent by use of metal powder, but a conductivity is still insufficient for use in an electromagnetic circuitry. Although the problems of metallic glossiness and conductivity may be solved by conventional hot stamping which transfers a metal foil onto a specially coated paper or sheet serving as a transfer target object, this target object is limited due to necessity of fabricating a die which defines the pattern of the metal foil. Further, the hot stamping raises an additional problem that the delivery period and cost increase.

In this embodiment, the thermal printer is constructed such that a transfer underlayer is formed with a thermally fusible ink of a color such as yellow Y, magenta M, or cyan C, and a specific material layer of a metal foil or the like is formed on the transfer underlayer and retained in a desired pattern by means of a selective adhesive function of the transfer underlayer. Since the metal foil is available instead of an ordinary color ink, no die is required unlike the hot stamping. It is preferable that the metal foil is covered by a durable film which prevents the conductivity of the metal foil from being deteriorated by corrosion. In a case where an electromagnetic circuitry such as an antenna is formed on a radio tag with use of metal power in thick film printing, a sintering process is required after printing. Further, since sufficient conductivity cannot be obtained without silver, the antenna is generally formed of a metal plate which is processed by pressure applied with use of a die. Neither a metal foil nor a thermally fusible ink is available in this process. In the thermal printer of the embodiment serving as a transfer apparatus, an inorganic film made of thermosetting resin, metal oxide, ceramics, or the like can be formed as the specific material layer of a desired pattern by means of a selective adhesive function of the transfer underlayer. With a conventional technique, the transfer underlayer and the specific material layer such as a metal foil are easily displaced from each other. Upon occurrence of a positional displacement, part of the transfer underlayer which is not masked by the specific material layer is observed if the transfer underlayer is not of an achromatic color. At this time, the specific material layer of a desired pattern also can not be set obtained. Accordingly, precise positioning of the transfer underlayer is important to obtain the specific material layer of a desired pattern.

In the thermal printer, heating areas of the thermal heads 2, 3, 4, 5 are variably selectable in the ordinary manner. The thermal printer becomes expensive if a high precision mechanism is used to correct a displacement between transfer positions of the thermal heads. Although such a positional displacement can be corrected at low cost by use of a software, the correction of the positional displacement is theoretically limited to ½ of a resolution. In this scheme, the positions of the thermal heads must be adjusted again upon replacement of the heads, inks, or paper. Further, it is difficult to perform the adjustment in a short time and at low cost while taking extension and contraction caused by heating into consideration.

The thermal printer of this embodiment is constituted such that a transfer underlayer of a desired pattern is transferred onto the transfer target object in advance, and a specific material layer is transferred by heating an area of the thermal head which covers the pattern of the transfer underlayer, thereby causing the specific material layer to be shaped in a desired pattern with no positional displacement with respect to the transfer underlayer.

Steps of obtaining print images having a mixture of an ordinary ink and a metal foil thereon will be described with reference to FIG. 2. The print image shown in FIG. 2(A) is obtained by forming a group of gothic style letters "TEC" with a metal foil and a group of letters "RESEARCH CENTER" with a ordinary black ink. In the thermal printer shown in FIG. 1, an ink layer is transferred from the transfer film 7 of an ink ribbon by the thermal head 2 as the transfer underlayer, a metallic layer is transferred from the transfer film 8 of a metal foil ribbon by the thermal head 3 as the specific material layer, and an ink layer is transferred from the transfer film 9 of a black ink ribbon by the thermal head 4. The thermal head 2 heats the ink ribbon with a desired pattern of the gothic style letters "TEC" shown in FIG. 2(B), and the thermal head 3 heats the metal foil ribbon with a pattern of FIG. 2(C1) larger than the desired pattern or a solid pattern of FIG. 2(C2). The specific material layer is adhered only to the transfer underlayer and shaped in a pattern determined by the transfer underlayer. Thereafter, the thermal head 4 heats the ink ribbon with a pattern of FIG. 2(D). In this way, the print image of FIG. 2(A) can be achieved without any positional displacement between the specific material layer and the transfer underlayer. The transfer positions of the specific material layer and the transfer underlayer may be displaced due to the configuration of a currently available printer. Although there is a software correction which can correct the displacement to ½ of a resolution at low cost irrespective of a use of the metal foil, the displacement can not be completely corrected. In this embodiment, a lamination transfer object can be produced with high precision even in the aforementioned situation. In the case where the specific material layer is heated all over, a rod like heater or a heat roll can be used instead of the thermal head. Thus, a heat/press fixing device for an electrophotographic machine can preferably be utilized. Moreover, in FIG. 2 (A), for example, in the case where only the group of the metallic letters "TEC" is necessary or several mm of positional displacement with respect to the group of the letters "RESERCH CENTER" is allowable, a metallic process can be performed by another machine such as a monochrome printer. If a sensor mark is provided on the rear side of a transfer target object, the positional precision can be improved by using the sensor to detect the sensor mark. If a transfer target object is formed as a seal like a tack, the object can be affixed to a curved surface. Further, if this curved surface is applied with heat and pressure by use of a heat resistant flexible member such as silicone rubber, transfer of a metal foil can be achieved on the curved surface. In addition, conventional hot stamping can be used to form the specific material layer if the transfer underlayer is formed on the transfer target object by a printer. In this case, a solid die can be used since the transfer pattern of the specific material layer is defined by that of the transfer underlayer. An ordinary label printer is capable of printing on a label paper in which a plurality of label sheets are arranged in series and separated from each other by a preset distance on a base film. Therefore, this printer is constituted to correct the positional displacement by detecting an optical difference (in quantity of transmitted light) between the label sheet and the base film. Accordingly, a monochrome label printer can be used without changing the existing configuration with respect to the positional precision. Conventionally labels for high class foods and the like are printed by hot stamping. In this case, an adjustment mechanism is provided to adjust the position of a metal die with high precision. However, such an adjustment mechanism can be simplified when the pattern of the specific material layer is defined by the transfer underlayer. In addition, the metal die can be a solid type. This die can be used commonly irrespective of change in the pattern of the specific material layer, and facilitate maintenance such as cleaning or the like.

Next, the print image shown in FIG. 2(E) will be described. In this print image, a Japanese character of gold is located inside a circular portion of the national flag of Japan, which portion symbolizes the sum and is printed in ordinary ink. In the thermal printer shown in FIG. 1, an ink layer is transferred from the transfer film 7 of a red ink ribbon by the thermal head 2 as the transfer underlayer, a metallic layer is transferred from the transfer film 8 of a gold color surface metal foil ribbon 8 by the thermal head 3 as the specific material layer, and an ink layer is transferred from the transfer film 9 of a black ink ribbon by the thermal head 4. As shown in FIG. 2(F), the thermal head 2 heats the red ink ribbon with a circle pattern for the sun and a circle pattern for the top sphere of a pole. As shown in FIG. 2(G), the thermal head 3 heats the metal foil ribbon with a character pattern for the Japanese character of gold located inside the first circle portion of the ink layer corresponding to the sun and a square pattern located not to cover the first circle portion and to cover the whole second circle portion of the ink layer corresponding to the top sphere of the pole. As shown in FIG. 2(H), the thermal head 4 heats the black ink ribbon with graphic patterns for the frame and pole of the national flag. The metal foil ribbon is heated with the square pattern to form the metallic layer to be aligned with the second circle portion of the ink layer corresponding to the top sphere of the pole. However, the metal foil ribbon can be heated with a pattern of a desired shape which is determined to have a size larger than the second circle portion of the ink layer by at least a margin for a positional displacement in transfer. Accordingly, the square pattern can be replaced, for example, with a circle pattern which has a radius extending its periphery up to about an half point of a distance between the first circle portion of the ink layer corresponding to the sun and the second circle portion of the ink layer corresponding to the top sphere of the pole and located to cover the second circle portion. Further, a positional displacement between the pole and the top sphere is not conspicuous in a lateral direction from the left to right side of the flag. However, the positional displacement is conspicuous in a vertical direction due to an undesirable gap created between the top sphere and the pole. Therefore, in this embodiment, a non-transfer function is provided on the surface of the metallic layer and the graphic pattern for the pole is located to overlap the metallic layer corresponding to the top sphere by at least a margin for the positional displacement. When the black ink ribbon is heated with this graphic pattern, the ink layer corresponding to the pole is not transferred on to the metallic layer corresponding to the top sphere. Thus, no cap is formed between the top sphere and the pole.

As mentioned above with reference to FIG. 2, a heating area is required to be determined according to an image pattern but this is automatically dealt with by a software or driver on the side of a printer or a computer. Such a control will be described later. In any way, with the method or apparatus adopted, even if no special technical gifts are available such that positional adjustments or exchanging dies are conducted for each transfer target object or each material quality of a film, the specific material layer of a desired pattern can be transferred to laminate the transfer target object with high precision to obtain a lamination transfer object having a desired property. Here, an optical effect of a print matter has mainly been described as the desired property.

An actual flag or a cloth piece can be produced if a racing number, cloth, non-woven fabric, wash-resistant paper or the like is used as the transfer target object. Preferable are named: cloth or non-woven fabric made of polyethylene, nylon 6, acetate, polyester and the like and a wash-resistant paper if it is made of paper as a base, and any material which can be used for ordinary offset printing can be adopted. Therefore, a metal plate such as stainless steel and a sheet coated with polyester can be used. In such a manner, even a special film can also be transferred thereon in such a manner as an ordinary ribbon is handled.

Processes of producing transfer films to be used for transferring the transfer underlayer and specific material layer will be described.

Herein, described will be conditions and a transfer film for use in performing by a thermal printer a metal foil transfer conventionally achieved by a metal foil transfer method, that is a so-called hot stamping, which requires a die.

Generally, in hot stamping, transfer is performed by means of an up/down transfer machine under application of heating approximately at a temperature in the range of 120 to 200° C. and pressure approximately at a value in the range of 1 to 10 kg/cm$^2$. At this point, conditions are chosen such that no burns occur in a vapor-deposited layer, good foil cutting is achieved and no foil tension arises, which are indispensable for high precision, but while in the thermal printer of FIG. 1, heating is controlled by a power supply time so as to enable a temperature to be arbitrarily varied in the range of room temperature and 400° C., a feed rate of a transfer target object is variably controlled in the range of 1 to 6 in/s and a power supply cycle and a pulse width of power supply can be controlled, in this embodiment, a condition of the order of 300° C. was adopted giving consideration to interchangeability with an ordinary thermally fusible ink since it is an ordinary transfer condition for the ordinary thermally fusible ink that a temperature reaches a temperature of the order of 300° C. in several $\mu$s in an adiabatic condition. A pressure is approximately set in the range of 10 to 20 kg/cm$^2$, which is a range of pressure for a currently used printer in which it is variably selected. As a transfer film which can be used in such conditions, it has eventually been found that burning is not required to receive consideration and there arises no problem even with a constitution in which burning would occur in hot stamping. If a die is used, the die has a very large heat capacity and a time under heat and pressure is long and even if a high precision type is used, applied energy is large and a time of energy application is long, so that sharpness in change of temperature is decreased. Therefore, what is to be considered for a thermal printer is that adhesiveness and separation of a base film to a transfer target object are most important as will be described later because of requirement of a high speed response in the range of several ms to tens of $\mu$s under heating, press and separation.

Figure 3:
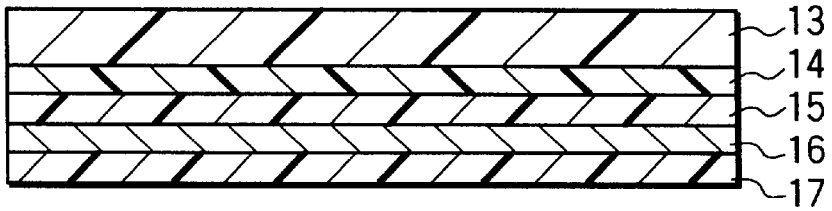
FIG. 3 is a sectional view showing a transfer film used in the thermal printer shown in FIG. 1.
Figure 4:
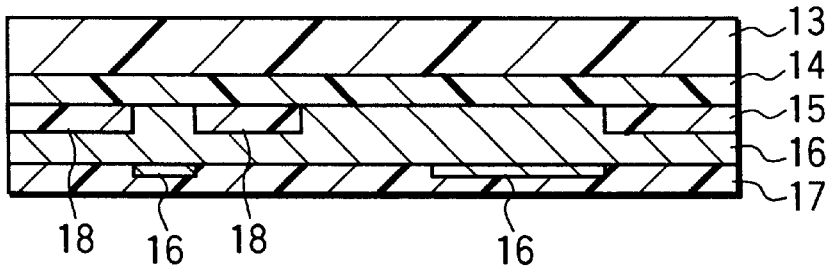
FIG. 4 is a sectional view showing a transfer film used in the thermal printer shown in FIG. 1 as well.

A structure and process for producing a transfer film will be described with reference to FIGS. 3 and 4.

A separation layer 14 made of acrylic resin, cellulose based resin wax or the like is formed on a base film 13 such as a polyethylenenaphthalate film, a polyethyleneterephtalate film (hereinafter referred to as PET film), a polyprolylene film, a polyamide film, an acetate film, a celophane film or the like by a coating apparatus such as a solvent coating apparatus, a hot melt coating apparatus, a rotary press gravure printing machine or the like and subsequently a vapor anchoring layer 14 made of a thermoplastic resin such as a acrylic resin, vinyl chloride-vinyl acetate resin or the like; a thermosetting resin such as polyisocyanate resin, polyimide resin, urethane elastomer resin, silicone resin or the like of a two part curing type; or crystalline poly 4-methylpentene-1 (hereinafter referred to as CMP) is formed thereon by use of a coating apparatus such as a solvent coating apparatus, a rotary press gravure printing machine or the like. At this point, curing for a thermosetting resin is required to heat at a temperature in the range of 160 to 200° C., but the heating may be omitted if a separation layer is adversely affected by the heating, and separation and vapor anchoring layers may be made of the same resin or only one of those may singly be used playing a role of the other. Though separation and vapor anchoring layers are mixed with each other to a some extent, the mixing does not cause any problem in transferability, and each of layers may have a sea-island texture like polymer alloy and there may be perfect compatibility whereby both are mixed therebetween as a solid solution. In the case of CMP, in order to make the CMP have a separation function, included is an additive such as an epoxy-fatty acid ester base plasticizer, montan acid-partially saponificated ester wax, silicone oil or the like, there can further be named as an additive: a thermal plastic resin such as chlorinated rubber, chlorinated polypropylene resin, thermoplastic acrylic resin, polyamide resin and rosin modified maleic acid resin or the like and there can still further be used as an additive, if it is a small quantity (0.5 to 1.0 part): a thermosetting resin such as n-butyl urea-melamine curing resin, polyisocyanate curing resin or the like. A separation layer and/or a vapor anchoring layer can have an arbitrary color by dispersing a corona therein as well. Thereby, each of the layers can have a gold color or a blue metallic color mentioned above. Besides, preprinting can also be performed, but a preprinting layer (18) including a letter or a picture can be printed by a gravure printing machine or the like before or after fabrication of a vapor anchoring layer as a process step. When a series of process steps are performed by a gravure printing machine, the process steps are equal to a multi-color gravure printing process. As an alternate, as described later, preprinting can be performed by thermal printing.

A solvent used in coating may be toluene, ethyl acetate, butyl acetate, MEK or the like which is constantly used in gravure printing, and a solvent in use is vaporized for drying by an existing solvent dryer (which can also be used for thermosetting).

A base film 13 on which separation/vapor deposited anchoring layers 14, 15 formed is transferred to a vacuum evaporation machine and a vapor deposited metal foil layer 16 made of Al or the like, which is the specific material layer, is vapor deposited on the surface of the vapor deposited anchoring film is formed according to an established method. Such a base film with a metal foil formed thereon is transferred to a gravure printing machine so as to be coated with a hot-melt adhesive layer 17 made of acrylic resin, polyacetic acid-vinyl resin, vinyl chloride resin or the like all over the film. The coat is dried and thereby completed is a transfer film for transferring of the metal foil, which is a specific material layer by a lamination transfer apparatus such as a thermal printer. A metal foil as the specific material layer may be formed in a thin film forming apparatus other than an evaporation system and an inorganic or organic film can arbitrarily be formed by sputtering, CVD, ion plating or the like. In order to pattern a metal foil in advance, a photolithography which has well be known can be used for the patterning and a well known thin film process which uses a mask in film formation can be utilized in patterning as well. Patterning of the specific material layer is one of the main objects of the present application as mentioned above and since this can be performed in a lamination transfer machine of the present application, for example a thermal printer, patterning and printing of a film in a transfer film producing process should be selected by considering a production amount, a delivery date and a price, or whether or not a special film such as hologram is requested and whether or not it can be fabricated in a lamination transfer apparatus at hand. For example, a hologram pattern requires a resolution of such an extent as a heat transfer machine having laser light as a heat source has and thereby generally, if a product as a predetermined diffraction grating film is used as a specific material layer, the specific material layer material can be obtained at a lower cost. Such a film is used as a base for a seal for children.

Physical properties of a base film, a transfer underlayer and specific material layer such as viscoelasticity and the like mainly affect durability such as heat resistance, dimensional precision, foil cutting and the like of a product (lamination transfer object) and in a printer, since a heat/press/separation process is performed in an instant, conditions are more moderate than an up/down transfer machine. What is required as a transfer film for a thermal printer as a lamination transfer machine of the present application is to satisfy conditions described later and, for example, a separation in a cooled condition is desirable in order to increase an adhesive force since the adhesive force is small during heating if a wax based material as an adhesive layer is used and separation in a hot condition is desirable since an adhesive force is too strong if an adhesive made of resin based or wax/resin base material is used and cooled and the like. In any case, desired properties can be obtained if viscoelasticity of each layer is measured and those can also be determined experimentally based on a thickness. As an example of a thickness of each material, the following data will be shown: a base film of 4.5 $\mu$m/a separation layer+a vapor deposited anchoring layer of 1.3 $\mu$m combined/a metal of 400 Å/a hot melt adhesive layer of1 $\mu$m were formed (herein, a reverse roll coat method is used and the coat was dried by a hot air blow at 120° C. and at an air speed of 50 m/min) and the transfer underlayer was formed with wax ink of 2.5 $\mu$m and then an Al film was able to be patterned at a resolution of 600 dpi on a plain paper in the thermal printer which was a lamination transfer machine of the present application. That is, a transferred object, such that wax and an Al metal were laminated on a plain paper, was able to be fabricated at a high speed without use of a die or a form plate. As a transfer target object, an ABS resin molded plate or the like can also be used and further obtainable is a product (lamination transfer object) such that a mirror (optical component) having an arbitrary pattern and an image (printed matter) are formed on an acrylic plate with a Frensnel lens formed therein. A vapor deposited anchoring layer is colored with a yellow corona described later and thereby a transfer film like a gold foil was obtained. In such a manner, a thickness and a material are determined based on what properties of a product are required as a lamination transfer object and an issue relating to forces such as an adhesive force is further required to be determined on the basis of the thickness and kind of material. When metallic glossiness is desired, the glossiness is optically measured and it is recommended to determine the lower limit of a thickness from a view point of a cost. In JIS Z 8741 Gs (60°)(Methods of measurement for specular glossiness), a glass surface is used as a reference (100%) and a glossiness of the surface was measured at 50% on a plain paper printed with an ink in which metal powder is dispersed like an ordinary ink but in this embodiment, a glossiness of 200% was obtained, which was a mirror like surface. If a half mirror is required, a thickness of a film is made thinner a little, whereas, for example, an ordinary mirror forming technique can be applied on a metal foil. In such a manner, a material quality and thickness of a film are determined based on whether requirements for characteristics of a product are those for decoration or a mirror. Thereafter, a design of each layer other than this film is conducted. It is natural that consideration will simultaneously given to a transfer target object and the transfer underlayer.

A constitution and fabrication process of a transfer underlayer and its selective adhesive function will be described.

In order to fabricate a product with a desired highly precise pattern, in which no positional displacement between a transfer underlayer and a specific material layer is present, since used is a specific material layer which cannot directly be heat-transferred on a transfer target object but can be transferred on the object on which a transfer underlayer of an arbitrary pattern is transferred in advance, or a transfer film as a specific material layer which can directly be heat-transferred on a transfer target object, which can be transferred on the object on which the transfer underlayer of an arbitrary pattern is transferred in advance, but which cannot directly be heat-transferred on the object when heat-transfer is conducted on the transfer underlayer, a transfer film which cannot directly be heat-transferred on a plain paper has been used in the above mentioned embodiment. If a transfer target object is not a plain paper and good in affinity for an adhesive layer of the transfer film, for example if it is an acrylic resin plate and an adhesive layer is also of an acrylic resin base, not only can a film directly transferred on the object but the film can also be transferred only on a transfer underlayer formed on the object if the transfer underlayer has been formed thereon. The example of a Frensnel lens has been described above.

In order to satisfy the former requirement, required are such functions that no adhesion to paper is effected under heat and pressure; or separation from paper or the like is effected, whereas no separation from a ribbon is effected, if being adhered; and adhesion and fixing to the transfer underlayer are effected as well.

In order to satisfy the latter requirement, required are such functions that adhesion to paper is not effected under heat and pressure in the presence of the transfer underlayer; or separation from paper or the like is effected, whereas no separation from a ribbon is effected, if being adhered; and adhesion and fixing to the transfer underlayer are effected.

While the functions mentioned above, that is a relation between forces are required to be satisfied, an ordinary ink and the transfer underlayer are herein described in order to explain a relation between forces and described will be the case where a lamination transfer object of the present application is fabricated with use of the ordinary ink.

While transfer by a thermal head using a wax based ink as ordinary ink has a merit that it makes printing on a rough paper or a plain paper possible, printed matters have hardship in use in environments of various kinds due to its weakness in abrasion resistance, light fastness and chemical resistance. As an ordinary ink which is excellent in abrasion resistance, light fastness, chemical resistance, a resin based ink is used and a thermosetting resin based ink has a merit that it is excellent in abrasion resistance, light fastness, chemical resistance. These kinds of ordinary ink include inks of various colors and spread over poor to good in transparency or hard to be influenced by a color of a substrate to a substrate to be seen-through. That is, since they have optical properties, they can be useful in addition of a particular property to an optical component as a lamination transfer object. It is needless to say that since the function is lost if a reflecting film of an optical component such as a mirror is corroded, the ink is utilized for addition of the durability to a lamination transfer object.

In the case where a lamination transfer object is obtained by a thermal head with use of the resin based inks, a synthetic paper with a high smoothness is used as a transfer target object since a resin based ink has a characteristic that it is not transferred on a rough paper and a plain paper. As mentioned above, a synthetic paper has a large durability such as abrasion resistance and the like and thereby it is well used when the resin based ink is used. That is, a durability of a transfer target object itself is a requirement. However, a synthetic paper has hardship in its treatment as waste since the synthetic paper is higher in cost than a plain paper, the synthetic paper cannot be broken or cut like a plain paper and besides there is a case when a paper has information thereon, and therefore, requests that an ink which is excellent in abrasion resistance, light fastness and chemical resistance is used on a rough paper or a plain paper have been increasing. That is, there are requests such as a request for an intermediate cost and quality or all the strong points without any faults. A transfer film may originally have a laminated form but the film is eventually established in consideration of the following relation between forces.

In order to perform transferring on a rough paper or a plain paper by use of a thermal head, two methods are available. One is that a transfer underlayer is first transferred with use of a wax based ink and then printing with a resin based ink is conducted, wherein a ink ribbon for a transfer underlayer is of a conventional type that separation is effected in a cold condition (an ink is transferred on a paper and after the ink is cooled, the paper and the ink are separated from each other and herein after referred to as cold separation type). The other is that a parting layer made of a wax base agent is inserted between a resin based ink layer and a base (herein after referred to as a wax/resin based ink) and when the resin based ink layer and a resin based component are both in a molten condition in a process of setting of a letter image under heating by a thermal head and, a ribbon is separated from a print paper, whereby an adhesive force of the resin based ink to the print paper is reinforced and as a result, the resin based ink is transferred to a rough paper or a plain paper. That is, this is an example of this embodiment in which a film is directly transferred. However, a cost of a wax base ink ribbon in which a wax based parting layer is provided on a resin based ink is high and sufficient abrasion resistance or the like as sufficient as obtained by use of a pure resin based ink cannot be achieved by the ribbon since wax is mixed into a ink component. It is natural to say that the ribbon can satisfactorily be obtained as an intermediate performance. When an ink ribbon for the transfer underlayer is separately prepared, the number of process steps is increased and thereby a cost is high. In order to use an ink ribbon for a transfer underlayer in separation in a cold condition, while the transfer underlayer itself cannot be transferred to a rough paper or a plain paper and is broken to form a hole therein, a transfer condition of the transfer underlayer is poor to form peaks and valleys on the surface especially when a high speed transfer of the transfer underlayer is effected at a setting speed of 4 in/s or higher and thereby in this case a transfer ratio of a resin based ink of a specific material layer is decreased, which can in turn cause a problem of deterioration in a quality of an image on a print matter and a method in which separation is performed in a hot condition (hereinafter referred to as hot separation method) may be used instead. As mentioned above, while there are problems of poor outer appearance and undesirable positional displacement since a transfer underlayer is transferred all over a print paper as an alternative of a coat paper in a solid manner and thereby a background of set letters has remained as traces of the transfer underlayer, no positional displacement is observed or if any the displacement is not conspicuous according to a process of this embodiment in which a lamination transfer object is a printed matter. Though the displacement is not conspicuous if a conventional transparent or white transfer underlayer is employed, in this case, a ribbon exclusively used for the transfer underlayer becomes necessary as mentioned here.

Thus, an ink ribbon used as a transfer underlayer here is a wax based ink or a wax/resin based ink ribbon, that is a role of an ordinary ink is included as one of a double roles and if necessary, it can be a resin based ribbon excellent in abrasion resistance or the like. A thermal head has a heating element at an end and has a structure that the head separates a ribbon from each layer on the object in a heat and pressure condition and thereby realizes uniform transfer of the transfer underlayer to a rough paper by hot separation.

As a base film for such a transfer underlayer, there can be applied: polyethyleneterephthalate, cellophane, polycarbonate, polyvinyl chloride, polyimide or the like.

A thickness of the base film is on the order in the range 1 to 15 $\mu$m, but a thickness in the range of 1 to 6 $\mu$m is preferred if considering mechanical strengths, transferability and the like of the transfer underlayer.

A separation layer has a viscosity at 100° C. of $1\times10^4$ cps or less and is a layer including a majority of a wax material. In order to form the separation layer, the following waxes are used singly or in a mixture: haze wax, bees wax, carnauba wax, microcrystalline wax, paraffin wax, rice wax, polyethylene based wax, polypropylene based wax, oxidized wax and the like. A melting point of a separation layer is preferably in the range of 60 to 90° C. A melting point is measured by a differential scanning calorimeter and corresponds to a central temperature of a heat absorption peak.

A wax based ink layer in the case where an ordinary ink is used as a transfer underlayer has a viscosity equal to that of a separation layer and a wax/resin based ink in the same case a viscosity at 100° C. is in the range of $1\times10^1$ to $2\times10^6$, the viscosity can be adjustable by a ratio between wax and resin and the layer is a layer having a such a binder and a colorant as main components.

As a resin used in this ink layer, the following resins can be used singly or in mixture: petroleum resin, polyethylene, polyvinyl chloride, ethylene, vinyl acetate copolymer, polyester resin, polyamide resin, acrylic resin, polystyrene and the like. These are mixed with a wax component or layered on a wax layer and a mixture and a layered structure are called a wax/resin based ink or structure and the case of single use of a resin is called a resin based ink. If a metallic film is included as a kind of ink ribbon, a structure that an aluminum vapor-deposited layer is inserted between ink layers is possible, whereby a variety of metallic glossiness in each color can be realized and such a ribbon can be regarded as a color ribbon that is, for example, red metallic. As a binder, it is not limited to a thermoplastic resin but a thermosetting resin can also be used.

As a colorant, carbon black is used for black, one or more kinds selected from the group consisting of pigments such as phthalocyanine blue, Victoria blue, lake and fast sky blue, and dyes such as Victoria blue and the like are used for cyan. As a colorant for magenta, one or more kinds selected from the group consisting of pigments such as rhodamine lake B, rhodamine lake T, rhodamine lake Y, permanent red 4R, brilliant fast scarlet, brilliant carmine BS, permanent red F5R, and dyes such as rohdamine and the like. As a colorant for yellow, one or more kinds selected from the group consisting of pigments such as benzidine yellow GR, Hanza yellow GR, Hanza yellow G, permanent yellow NCG and the like, and dyes such as auramine and the like.

Density of each of a parting layer and an ink layer is both about 1 g/cm$^3$ and a coating quantity of an ink layer of a wax based or resin based ink ribbon is in the range of 1 to 3 g/cm$^2$ (as a film thickness, corresponds to about in the range of 1 to 3 $\mu$m), and a coating quantity of a separation and ink layer of a wax/resin based ink ribbon is in the range of 1 to 3 g/cm$^2$ (as a film thickness, corresponds to about in the range of 1 to 3 $\mu$m) and while a ratio of coating quantities is about 1:1, the ratio can be adjusted in a proper manner based on a required viscosity.

As a transfer underlayer of the present application, the above mentioned wax based or wax/resin based ribbons can be used in hot and cold separation conditions. A resin base ink transferred as a specific material layer on the transfer underlayer and an adhesive layer are selected in the above mentioned materials and if there is compatibility with a transfer underlayer material, an adhesive force to satisfy a relation between forces described later is obtained. A resin based ink having compatibility with a transfer target object can be used as a transfer underlayer material. Any of the inks satisfies the relation between forces as a necessary condition.

Though it had been understood that an ordinary ink can be transferred on a flat and smooth transfer object, it is found from experiments that in the case of a transfer target object with a surface roughness of 4 $\mu$m or more under pressure of 20 kg/cm$^3$ or more (called as a rough paper in the above description), a hole arises and a thickness becomes uneven when a conventional ink is used. Because of measuring a roughness on surface is required under application of pressure when a ordinary ink is transferred an optical dynamic printing smoothness tester microtopograph (made by Toyo Seiki K.K.) is used. This tester is an apparatus for measuring a physical quantity proportional to an average depth of recesses, that is a roughness Rp (printing roughness), on a transfer target object when the object is pressed on a flat surface of a prism. Under application of a pressure, a roughness is reduced though it is affected by a magnitude of an elasticity of the transfer target object and a condition of pressure is determined based on a transfer ratio and uniformity, and a limit of the pressure in practical use is determined by giving consideration to a critical value in excess of which wrinkles arise on an ink ribbon or degradation of layers also occurs and the degradation is easy to occur in conditions of pressure of 20 kg/cm$^2$ or more.

For a transfer target object whose surface is rough, transfer must be conducted while recesses and projections on the surface are buried by a transfer underlayer or decreased by bridging by the transfer underlayer. While a thickness of the transfer underlayer is properly adjusted in dependence on recesses and projections in order that the transfer underlayer is formed in a uniform manner, the thickness of the transfer underlayer is sufficient at a value in the range of 2 to 4 $\mu$m if the roughness under a pressure as described above is 4 $\mu$m. In the case where an elasticity and viscosity of the transfer underlayer is rapidly decreased as in the case of a wax based ink when the transfer underlayer is molten, the thickness may be 10 to 20 $\mu$m and while in this case, applied energy is required to be adjusted according to a melting point as is when an ordinary ink is transferred, recess filling or bridging can be achieved while the transfer underlayer does not very much infiltrate into even a transfer target object, which is subject to infiltration, if the energy is set at a low level. Especially, in the case of a wax based ink, an energy is set so as not to be too much. Determination of an amount of the energy is conducted based on experiments. Being compared with the same material, in the case where a wax based ink of 1.5 $\mu$m thick is lamination-transferred on a transfer underlayer of 4 $\mu$m thick made of an wax based ink, an applied energy is smaller when the transfer underlayer is transferred than when an ink is transferred by 10 to 40%. In this embodiment, in the case where a specific material layer is not made of an ink but a metal or the like, the difference is further larger and it was found that in the case where a wax/resin based or a resin based ink was used as a transfer underlayer, the difference in applied energy between when the transfer underlayer was transferred and when the specific material layer such as metal was transferred was in the range of 0 to 50%, though the difference was influenced by a thickness of the specific material layer.

Description will be repeated to show procedures of lamination-transfer. If a transfer operation gets started while using a plain paper as a transfer target object, a transfer underlayer is first transferred on the paper by a thermal head 2 and subsequently, a specific material layer is superposed on the transfer underlayer by a thermal head 3 to fabricate a lamination transfer object. At this point, since the specific material layer has a characteristic that the specific material layer cannot directly transferred on the paper, if a pattern of a font or the like which is desired to be formed by the specific material layer, for example a Japanese character of "あ", is formed by the transfer underlayer in advance and even if a transfer film of the specific material layer is heated in a solid manner by the thermal head 3, the desired font of the Japanese character of "あ" is formed on the paper by the specific material layer.

In this embodiment, since a thermal printer is a color thermal printer which uses an ordinary ink as a transfer underlayer and a specific material layer, usually wax/resin based ink ribbons each of a hot separation type with yellow, magenta, cyan and black are respectively used in four thermal heads and a high speed color lamination-transfer is performed at a speed of 4 inch/second or more. When a resin based ink which is excellent in abrasion resistance and the like is used, it is recommended that one of the above mentioned ribbons, which are usually used, is used at a position of the thermal head (2) and a resin based ribbon or a special film ribbon as the specific material layer is used in one or all of the other thermal heads 3, 4, 5 downstream of the thermal head 2. While in such a manner, description has been given on an example in which an ordinary thermally fusible ink can be used as a transfer underlayer in a double role manner, a method of separation will be described below.

Figure 5:
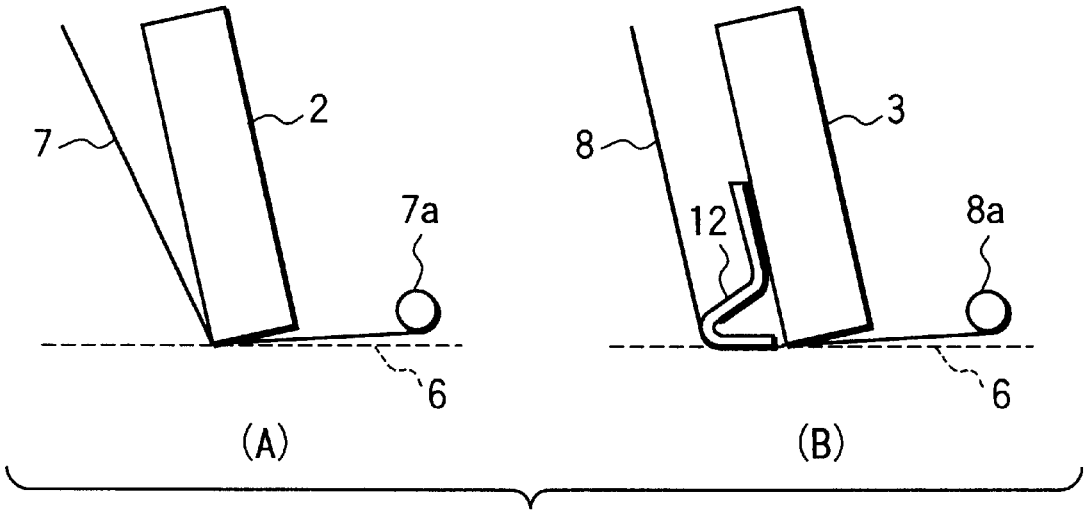
FIG. 5 is representation illustrating separation schemes of separating a transfer film from a thermal head of the thermal printer shown in FIG. 1.

FIGS. 5(*a*) and 5(*b*) respectively show a hot separation method and a cold separation method. An enlarged view of part of the printer as a lamination transfer machine described with reference to FIG. 1 is shown as a schematic view. Accordingly, a transfer target object 6 drawn with a dotted line moves along a direction from the right hand to the left hand as viewed with a long side of the sheet positioned vertically, an ink ribbon or a transfer film 7 or 8 is fed from a feed roll 7*a* or, 8*a* and the ribbon or film is taken up on a take-up roll 7*b* or 8*b*. At this point, in a hot separation condition, a head 2 separates the ribbon immediately after heat and pressure and in a cold condition, the ribbon is separated after being cooled in a proper manner by a separation plate 12. Which method is better is dependent on uniformity in transfer, for example, affected by affinity with the transfer target object and if the following conditions are satisfied in a transfer process in which heating, pressure and separation are effected, an arbitrary transfer target object, an arbitrary transfer underlayer, and an arbitrary specific material layer can be used. In this embodiment, a head is freely mounted and dismounted and exchange of methods based on the existence or not of a separation plate is easy. A position of the parting plate can be changed according to its length. The position is also properly adjusted based on conditions such as a kind of material, a transfer speed and the like. Such adjustments are means for satisfying a relation between forces described below. This is an example which shows that a degree of freedom in choice on the material side is broadened by adjustments on the apparatus side.

A Relation Between Forces

In the case where a specific material layer is heat-transferred on an object having a transferred transfer underlayer of an arbitrary pattern with use of a transfer film made of a base film and a specific material layer of a desired material quality thereon, if a transfer target object, transfer underlayer and specific material layer are selected in such a manner that, in an area in which the transfer underlayer is not present when heat and pressure are applied or when separation is conducted, an adhesive force between the base film and specific material layer of the transfer film for the specific material layer and a retaining force of the specific material layer itself is larger than an adhesive force between the specific material layer and the transfer target object; in an area in which the transfer underlayer is present when heat and pressure are applied, a retaining force of the specific material layer itself, an adhesive force between the specific material layer and the transfer underlayer, a retaining force of the transfer underlayer itself, an adhesive force between the transfer underlayer and a transfer target object and a retaining force of the transfer target object itself is larger than an adhesive force between the base film and specific material layer of the transfer film for the specific material layer; and in the area in which the transfer underlayer is present when separation is conducted, an adhesive force between the specific material layer and the transfer underlayer and a retaining force of the transfer underlayer itself is larger than an adhesive force between the base film and the specific material layer of the transfer film for the specific material layer, a lamination transfer object with a desired high precision pattern can be formed without any positional displacement between the transfer underlayer and the specific material layer.

Recommendable is that when a specific material layer of a multi-layer structure with separate functions is employed or of a function with a gradient and uneven distribution therein is used, an adhesive force between the base film and the specific material layer of the transfer layer film for the specific material layer and an adhesive force between the transfer target object and the specific material layer are compared with other forces at a boundary, which is defined to be the surface of the specific material layer or a plane in the vicinity thereof; when it is an indispensable condition that a retaining force of the specific material layer itself is larger in its relative magnitude, the smallest retaining force in the specific material layer is compared with other forces; and when it is an indispensable condition that a retaining force of the specific material layer itself is smaller in its relative magnitude, the largest retaining force in the specific material layer is compared with other forces. When a portion having a smaller retaining force is present in the vicinity of the surface of the specific material layer, it is regarded to be a condition that a retaining force is larger than an adhesive force in relative magnitude of the indispensable condition, whereas when a portion having a larger retaining force is present in the vicinity of the surface of the specific material layer, it is regarded to be a condition that an adhesive force is larger than a retaining force in an inequality. In this case, a condition is alleviated and an equality sign may be deleted. In such a manner, when indispensable conditions are to be satisfied, it is recommended that a relation of the relative magnitude is actually designed as a constitution of materials and for example, a wax/resin based ink is the case. Instead, it is recommended that a material is used in a uniform state and a temperature gradient is designed, and since a temperature of the head side, that is the base side, is higher, for example, a separation layer has a smaller viscoelasticity and therefore, a desired function can be realized so as to satisfy the indispensable conditions.

Any way, in the case of a multilayer structure, mixing occurs at a boundary in the course of producing each layer and in some case, there is a chance where adjacent two layers form an apparent one layer due to compatibility, so that in such a case, boundaries are unclear so as not to enable specific material layer, separation and adhesive layers to be discerned from one another. In the case of an ink, since all that is required is to obtain a necessary color or durability, if the above mentioned relation between forces is satisfied, required characteristics such as a desired color and durability are attained even if mixing between layers or between the transfer underlayer and an ink occurs.

In order to satisfy these indispensable conditions, in a concrete manner, condition setting is achieved in consideration of a pressure, adhesiveness, a physical anchoring effect, wettability, compatibility, temperature vs. viscoelasticity, a ribbon tension, a tension of a transfer target object, a speed and the like. While even when a thickness is a one of the set conditions, the relation between forces is satisfied, and conditions of a glossiness and protection of required characteristics are further satisfied, there is a case where a trade-off occurs, the examples shown in this embodiment satisfy the relation between forces by designing a temperature gradient and material composition. Since basically, the relation between forces has to be satisfied, designing of a composition can be conducted in consideration of viscoelasticities, adhesive forces and compatibilities of each material at respective temperatures. For example, adoption of a hot separation method is because when a viscoelasticity of a material in the vicinity of the base side of the specific material layer is reduced owing to a temperature gradient, an adhesive force on the transfer underlayer side or the transfer target object side is dominant, so that transfer can be achieved. To the contrary, adoption of a cold separation is because a viscoelasticity is increased by cooling and thereby an adhesive force (to the transfer target object) is increased (such an increase in the adhesive force is required). Since numerical values used for a rough design at a level only are obtained in measurement on viscoelasticity, there is a need for confirming the conditions such as a speed in actual transfer. In the embodiment, a metal foil is shown as an example. An inorganic material such as ceramic or the like can be used. In the case where these specific materials are in the form of a film, a viscoelasticity can be neglected and it is only required to consider a shearing force as compared with separation and adhesive layers. That is, it is only required that a shearing force required for breaking is in advance measured and a design is conducted by regarding the inorganic film as a layer (film) whose viscoelasticity is not changed so much as a viscosity of a resin is even when it is heated and which is disconnected at a constant shearing force, and thereby that an adhesive force (adhesiveness) to a layer on which the film material abuts or a material of the layer satisfies the relation between forces. However, when a white or a metallic film layer is fabricated with use of powder of ceramic or a metal as a pigment, it is necessary to consider that a viscoelasticity is changed by heating. While alumina can be used as a white ink, if powder or a film material of black or brown color is used, a lamination transfer object with an insulating property or a decorative nature representing an inorganic object such as a stone or the like can be obtained.

An example of constitution of an ink ribbon which satisfies the relation between forces:

An ink (film) is present in the ink ribbon, said ink ribbon having functions a half mirror, hologram, a reflecting plate (light diffusion film), high light resistance, high abrasion resistance, high chemical resistance with use of a thin film made of a metal, ceramic, thermosetting resin or the like.

These ink ribbons have a large retaining force of the ink itself and can satisfy the relation between forces with ease.

An adhesive layer is present in the transfer target object side.

a separation layer (release layer) is present in the ribbon base side.

These function separation type layer are a wax or a wax/resin mixture type layer. A specific material layer can be of a wax/resin type in a double role manner. Methods to be applied are dispersion and emulsification and there is the case where the ink ribbon is called a polymer alloy and has a sea-island texture. It is also possible with the case of a thermosetting resin/a thermoplastic resin mixture type.

With a metal foil in use, since it has conductivity, transfer of an electromagnetic shield film, an electrical circuitry or an interconnect can be performed as in the case of a product of a radio tag as mentioned above. In order to maintain conductivity of a corrosive material such as aluminum, it is recommended to adopt a structure in which a protective film is provided, as in the case where a metallic glossiness is retained and, even with an aluminum film of 400 Å as shown in the embodiment, a resistivity is retained as is with aluminum metal. However, with this thickness, since a current capacity is small, it is required to increase a thickness and in the case of an interconnection pattern of a width of 35 $\mu$m and a thickness of 0.1 $\mu$m, power of about 0.2 W can be used without heat generation. Since such power as large as this is not required in many cases, it is advantageous to decrease a thickness as much as possible in regard to a resolution and a cost, for example to set a thickness to be on the order of 0.1 $\mu$m. Durability (against heat, oil, solvent, scratching and the like) is guaranteed even with a product from hot stamping with a die and a protective film can be formed with the same material in even interconnection use. If a transfer film of a specific material layer is constituted so that the above mentioned relation between forces is satisfied, a interconnection pattern can be transferred by a printer. A problem is considered to be how an electric terminal is fabricated at the same time but if a copper film was the case, soldering was able to be possible. The reason why is that if a protective film has heat resistance up to about 200° C., a thermosetting plastic resin is subjected to thermal decomposition to establish a contact between a metal foil and the solder. Though it is natural, conductive films such as films made of gold, other metals, carbon and the like can be transferred. In mounting of components by wire bonding or die bonding, compatibility between a heat/pressure condition and metals when the mounting is performed is required to be considered. In a practical approach, it is required to preform a solder coat on a terminal (such as pad) before bonding. It is possible to form a metal foil of a multi-layer so as to include a solder and a metal, and such a metal multi-layered film is transferred and a combination of ceramics and an insulating film or only an insulating film can be transferred. Therefore, electronic components and circuits of some kinds including a resistor, electrode and the like can also be transferred. Even with an aluminum film only, a circuit including a resistor of 100Ω was able to be transferred. A remaining film after transfer can be used as a film with a negative pattern. For example, a remaining pattern is formed so as to be a desired pattern and after transfer, a remaining film is wound on a take-up role and then the take-up side and feed side are reversed when a film is reused, whereby for example, if heating is applied in a solid manner, a desired pattern is transferred on a transfer underlayer without rewinding back on the feed roll. This pattern may be utilized for an electronic component, printing parts such as half tone dots, a logo and the like. Formation of a remaining pattern can also be performed as a desired pattern by patterning an adhesive layer when the adhesive layer is coated by gravure printing in the constitution of a transfer film and as is exemplified herein, in the case where a transfer process is employed, the remaining pattern can also be achieved even by a method for an adhesive layer only to be transferred under application of a lowered heat energy in transferring. Though it is natural, transfer of a pattern having an optical result such as refraction or diffraction is also possible and a film of a hologram or the like which has conventionally been fabricated by blanking with a die can also be transferred in an arbitrary shape. While a hologram can be fabricated according to a conventional method, it is only required in order to transfer in a thermal printer that the relation between forces is satisfied. While an optical effect film such as a reflecting mirror has conventionally transferred on an exclusive use sheet or plate without transfer of a transfer underlayer, such a special film can be transferred on an arbitrary object such as a plain paper without any positional displacement according to the present application. Besides, not only can a different kind of film be formed by superposing the film on a film transferred by a conventional method but a transferred film can also be formed in an area other than the transfer underlayer portion with good precision. That is, a conventional transfer film is used so as to play double roles including a role as the transfer underlayer and non-transfer function can be provided therefor. In such a manner, with a selective adhesion function and a non-transfer function, an electro-magnetic circuitry and an optical circuitry can be formed on the same transfer target object. The non-transfer function is a reverse function to that of a transfer underlayer and a function whereby transfer cannot be effected on a film on which transfer cannot be effected. The reason why is that an adhesive force does not occur though an example is not shown here since the function has been shown in an example of FIG. 2 and it is almost the same as improvement on durability such as chemical resistance by a protective film. While a material with a large contact angle of wettability does not adhere, it is only required that a relation between forces is reverse to the above mentioned relation between forces.

A lamination transfer object with high precision is, for example to form a circuit structure such that light is controlled to be in states of on or off or an optical or magnetic memory. Since a simple optical memory can store information only as a difference in reflectivity, it is only required to form a desired pattern on an arbitrary transfer target object, but in this case, a high resolution energy applying means such as a laser light source used for a laser thermal transfer as a head, a high precision transfer target object transport means of a drum type and the like are used. When a second and transfer underlayer which have a color of a poor optothermal conversion efficacy are transferred, a colored (mainly black) heat resistant film made of PET, polyimide, polyethyleneterenaphthalate or the like is stuck thereon in close contact relation and the film is used as a heat generating layer. These are ordinarily used in a conventional laser thermal transfer method.

Figure 6:
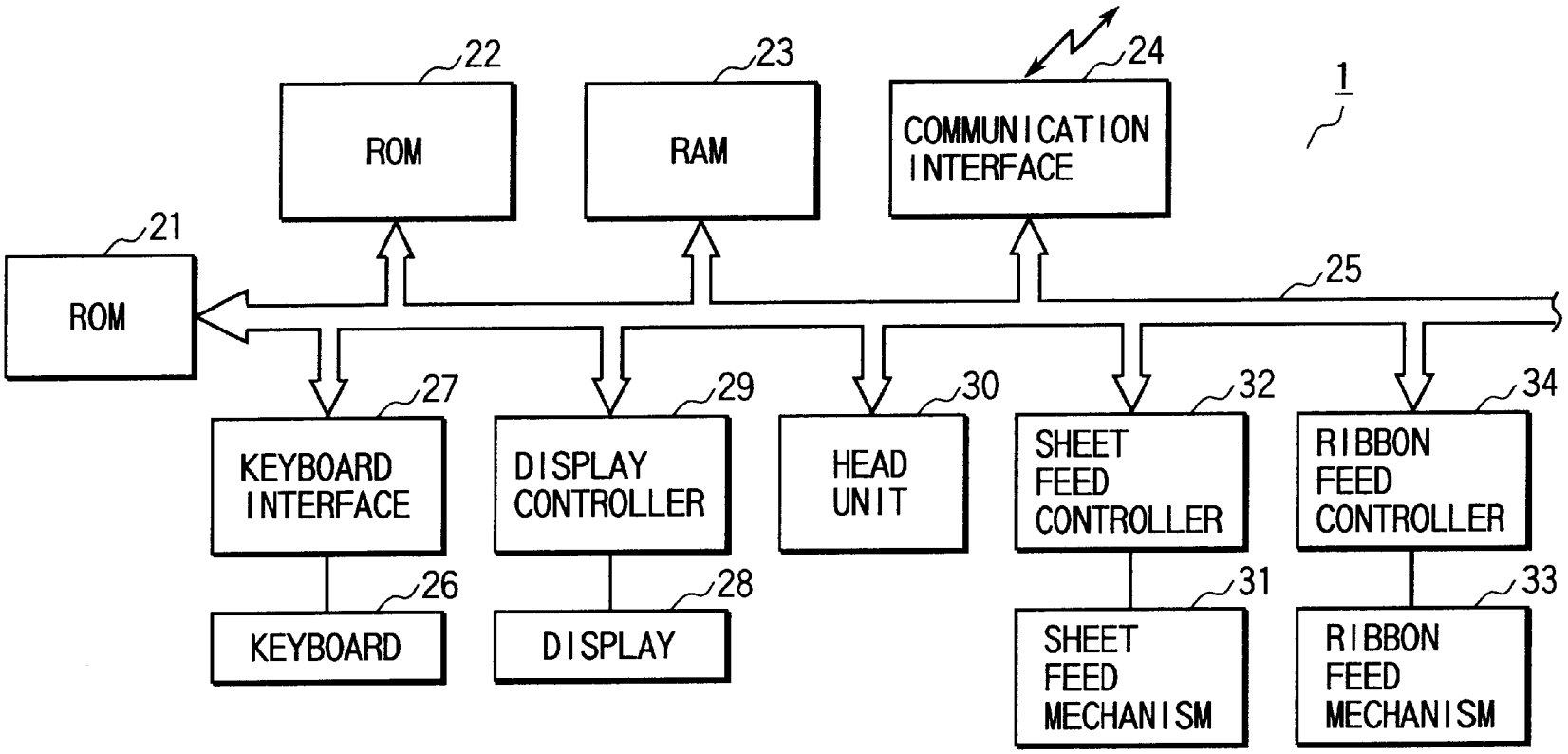
FIG. 6 is a schematic block diagram showing constitution of a control circuit of the thermal printer shown in FIG. 1.

With reference to FIG. 6, a control circuit of the color thermal printer which is a lamination transfer machine with the above mentioned structure will be described. FIG. 6 shows the constitution of a control circuit of the thermal printer 1. The thermal printer includes a CPU 21 for controlling the whole operation, a ROM 22 for storing a program data for processing effected by the CPU 21, a RAM 23 having storage areas for storing various kinds of data to be used by the CPU 21, a communication interface 24 for controlling data communication with an external system such as a host computer connected thereto via a communication line, and a system bus connected between these components.

The CPU 21 is further connected, through the system bus 25, to a key board interface 27 for controlling data transmission with a key board 26, a display controller 29 for controlling a display unit 28, a head section 30, a sheet feed controller 32 for controlling a sheet feed mechanism 31, a ribbon feed controller 34 for controlling a ribbon feed mechanism 33. Under the control of the sheet feed controller 32, the sheet feed mechanism 31 feeds the print paper 11 to sequentially pass the thermal heads 2 to 5 along the print paper transport route 6. Under the control of the ribbon feed controller 34, the ribbon feed mechanism 33 feeds the transfer films 7 to 10 from the feed rolls 7*a* to 10*a* to wind the transfer films 7 to 10 used by the thermal heads 2 to 5 into the take-up rolls 7*b* to 10*b*.

Figure 7:
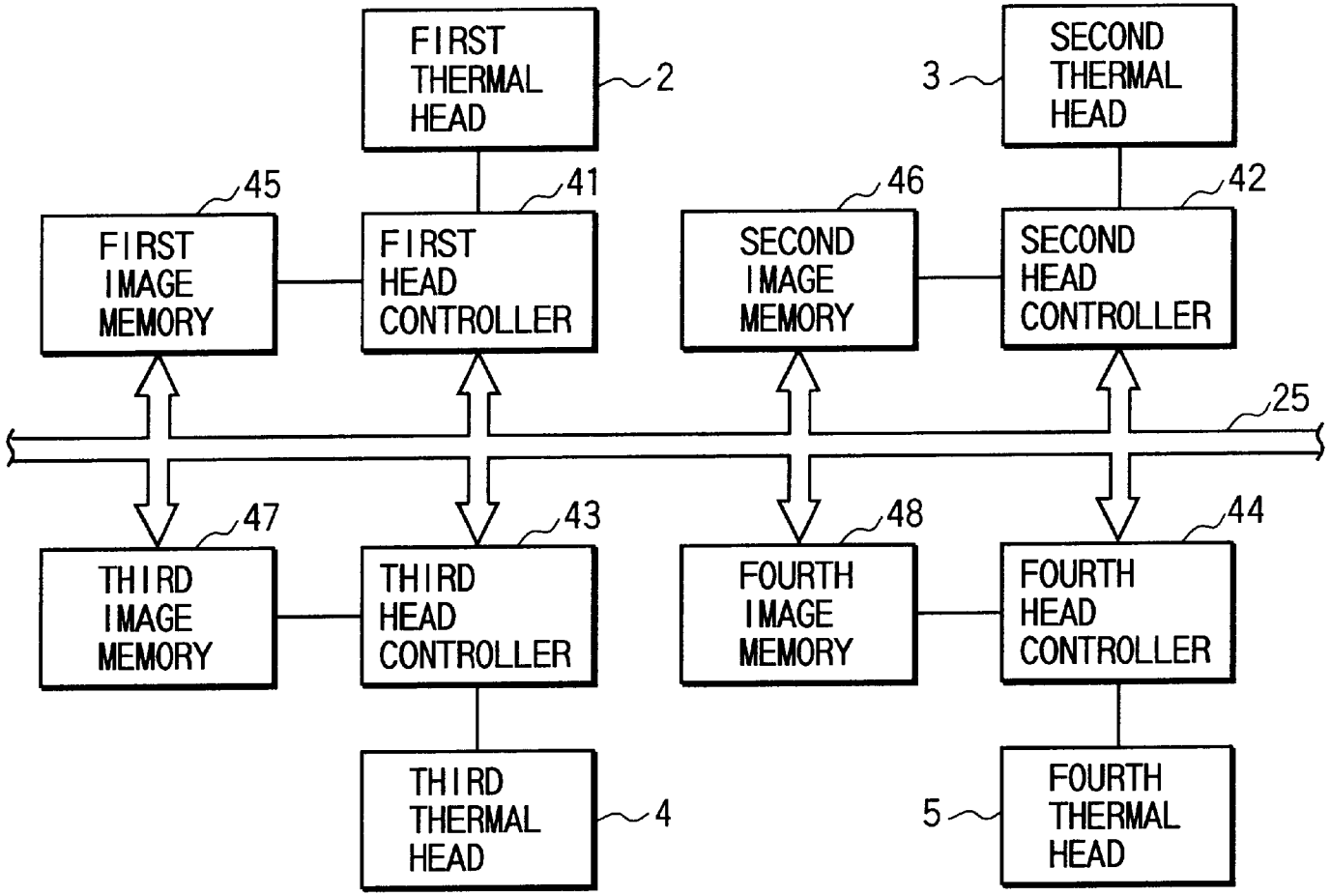
FIG. 7 is a block diagram showing an image writing process circuit of the thermal printer shown in FIG. 1.

FIG. 7 is a block diagram showing a constitution of a main part of the head section 30. In the head section 30, the system bus 25 is respectively connected to first, second, third and fourth head control sections 41 to 44 for controlling the first, second, third and fourth thermal heads 2 to 5, and to first, second, third and fourth image memories 45 to 48 for storing image data for the first, second, third and fourth thermal heads 2 to 5. The image memories 45 to 48 are also connected to the head control sections 41 to 44, respectively.

Figure 8:
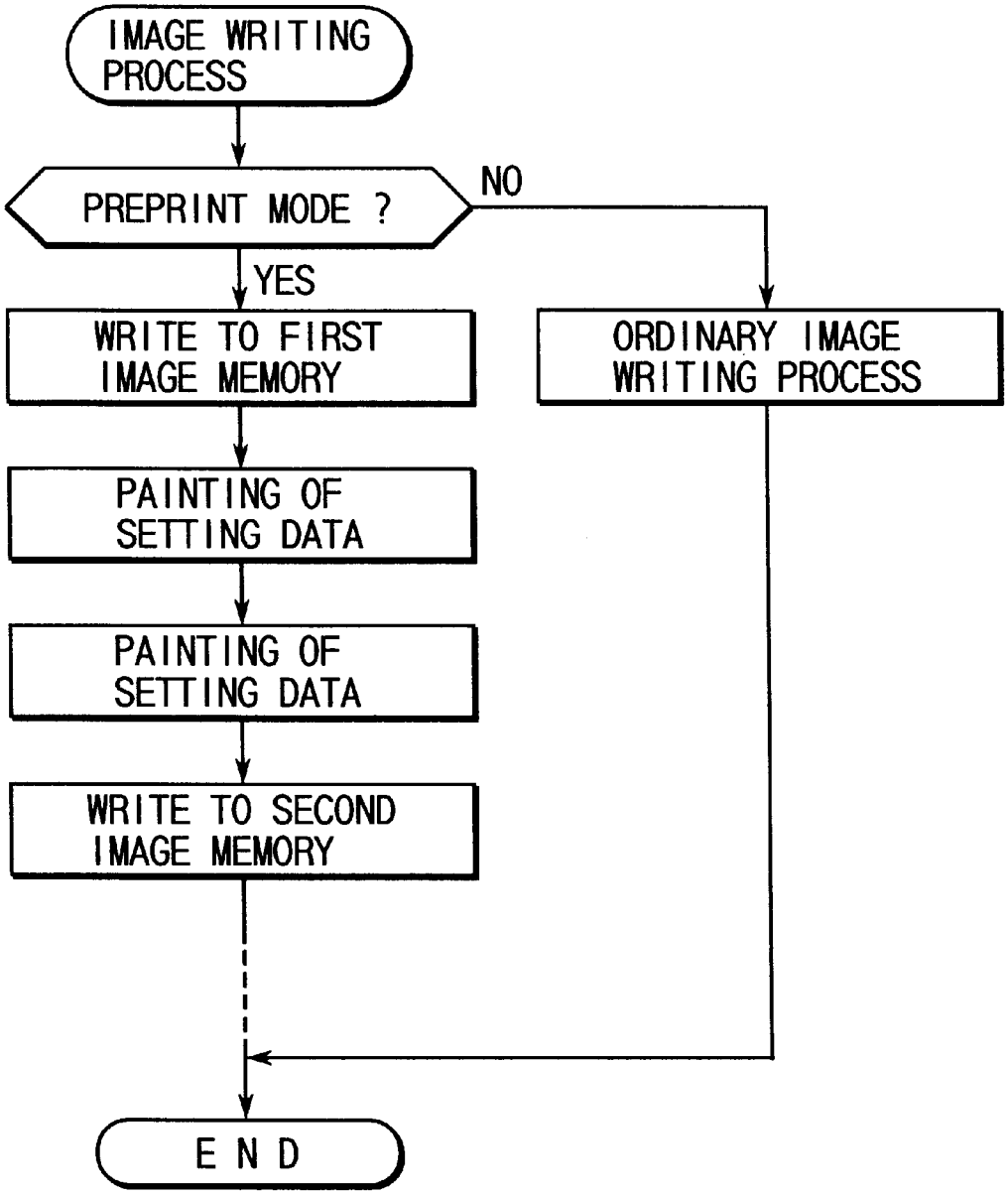
FIG. 8 is a flowchart of an image writing process performed in the thermal printer shown in FIG. 1.

FIG. 8 is a diagram showing a flow of image writing conducted by the CPU 21. First, transfer of a transfer underlayer is performed and then it is determined whether or not the process is in a lamination transfer object producing mode in which a specific material layer (special film) is transferred on the transfer underlayer.

Here, if it is determined that the process is not in the lamination transfer object producing mode, an ordinary image writing process is conducted and the process is terminated. As an image writing process, for example image data in yellow, magenta, cyan and black are respectively developed in the image memories 45 to 48.

On the other hand, if it is confirmed that the process is in the lamination transfer object producing mode, desired pattern data of the specific material layer is developed into an image data and the developed image data is written in the first image memory 45. At this point, as has been described with reference to FIG. 2, a transfer area for the transfer underlayer is selected based on a desired pattern and image data is determined selection and determination are described later. Here, description will again be made on the case where the FIG. 2 (A) is produced in a easy manner. That is, the transfer area for transfer underlayer is selected to be a portion of the FIG. 2 (B) and image data for the transfer area is written.

Then, a painting process is conducted with respect to the developed image data while giving consideration to positional displacement between a transfer position by the first thermal head 2 and a transfer position by the second thermal head 3. In this process, the image data, for example, of one dot is expanded to 5×5 dot square with one dot located at the center, and written in the second image memory 46. In the examples of FIG. 2(C1) and FIG. 2(C2), the image data is determined so as to cover the transfer area in a quadrangular shape. An energy saving effect can be obtained if the area is small, and a transfer error caused by a positional displacement can be reduced if the area is larger and thereby they are setting items as a energy saving mode and a high precision mode. While there are the case where energy consumption has to be large with a low resolution according to a material quality and a film thickness or the case where head exchange has to be demanded (exchanges in a hot separation and in a cold condition), since these are predicted, they are only required to be stored programming in a software. Further description in detail will be made later since overlapping with a user interface arises.

Figure 2:
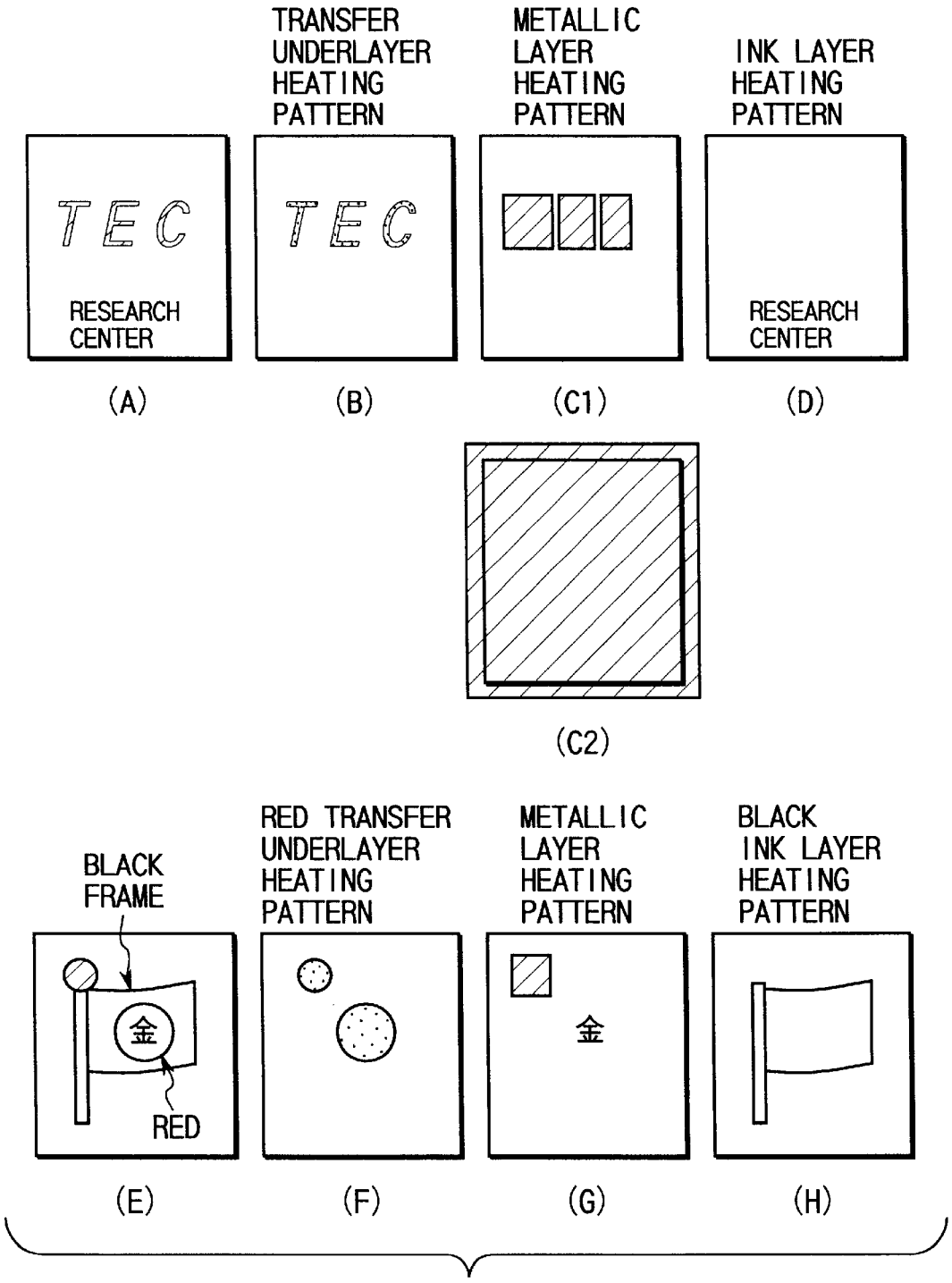
FIG. 2 is representation illustrating print images having a mixture of an ordinary ink and a metal foil, and obtained in the thermal printer shown in FIG. 1.

Though the following process is not shown, since "RESEARCH CENTER" of FIG. 2(A) is transferred with an ordinary ink, a desired ink is set at a remaining head and an image memory corresponding to the head is subjected to image writing process. As shown in FIG. 2 (C1) and (C2), if an image data corresponding to a heating area of the specific material layer transfer film and a heating area for an ordinary ink (can also be used as precoat) are spaced apart from each other by a distance larger than an error of positional displacement, a transfer order may be FIG. 2(D) →FIG. 2(B)→FIG. 2(C1) or FIG. 2(B)→FIG. 2(D)→FIG. 2(C1), or as mentioned in the description, FIG. 2(B)→FIG. 2(C1) or FIG. 2(C2)→FIG. 2(D). If one of the cases is impossible, positional relations of combinations of a head and transfer film or ink have to be changed. Though it is not described in this embodiment, in a printer in which one head is used and ink cassettes are automatically exchanged, if there is selected the case where the shortest time is realized, operations can proceed in a similar manner to a conventional ink selection. It is needless to say that since the number of cassettes is increased, setting by a user is required.

If it is judged that the process is not in a lamination transfer mode, an ordinary transfer process is conducted and the transfer process is terminated, but even in the case of an ordinary process, if conditions that the existence or not of a separation plate 12, a transfer speed and what is a transfer target object do not match a transfer film and an ink, both provided, an error display is shown, which requests a user to take an action to counter. Though it is natural for the user to be able to enforce printing by the user's judgment, there are is a chance where positional displacement or a change in concentration is caused.

In such a manner, since there is a case where user interface is necessary, described will be control with use of a software in which consideration is given to transfer means and method.

Generally, a pattern (an image or the like) which a user has fabricated with use of an application program of a host computer is judged by a software (a driver) on how which transfer film or ink is subjected to lamination transfer and a printer is controlled based on the judgment. For example, it can be detected whether which transfer film or ink is set in the printer by a sensor and mistakes are minimized. When a user conducts all operations, the driver shows necessary information about the existence or not of a transfer film or an ink, or in which head section setting is made on a display unit of the host computer and/or the printer. In any case, a support to assist a user in setting is displayed on a screen with use of a software. In such a way, the user performs some of operations the printer cannot execute. Such ordinary procedures or methods are omitted here and description will not given any more, but in settings to satisfy the relation between forces, an energy pattern to be applied and an area on which energy is applied (write image) are determined so as to satisfy conditions which the user desires. If these do not satisfy the user's desired conditions, candidates for settings closer to the ideal parameters are displayed and the process is then left up to the user's judgment. In any event, parameters which have been optimized in terms of combinations of the transfer target object, transfer underlayer, transfer film and ink are stored in ROM of the driver or printer in advance.

While description has been given on the example in which only a transfer film is transferred by a different monochrome printer, since a label printer is operated in such a manner that positioning of label patterns is conducted by positional detection which a sensor performs, solid area heating is not necessarily required and while a monochrome printer can sufficiently serves for not only FIG. 2(B) but, FIG. 2(C1), FIG. 2(C2) and FIG. 2(D) in the second example, the driver can also perform instructions on or confirmation of a series of related operations on the side of the host computer. There is no problem if the process is left up to user's choice, which is called a roll sharing mode.

Such operations as cannot be dealt with on the host computer and/or the printer side, for example exchange of transfer films or heads are dependent on a user's cooperation and since an error can be detected, forced transfer may be carried out as a trial transfer. Such a transfer may be set as a confirmation mode.

Since applied parameters have conventionally been adjusted with choices on a transfer target object, a transfer film and an ink in other cases than the case of lamination and head replacement and selection on separation methods have also been performed, requirements to be especially provided in this embodiment are to judge and determine what area which transfer underlayer should be heat-transferred in or what area a specific material layer transfer film or ink is heated in, or what sequence should be selected in the process. Since fundamentals have been described, description will be made on a concrete example below.

Examples of constitution for first and second transfer films are shown as follows, wherein determinations on a heating area and sequence in the case where the layers are used are performed by a software.

An ordinary ink and a transfer underlayer constitutes the same ribbon, for which white or an achromatic color has conventionally be used.

All kinds of ordinary inks, which have been set, each have a selective adhesive function, wherein an adhesive layer and a used ink satisfies the relation between forces.

A color of a transfer underlayer is of the same kind as a specific material layer or a desired color, for example if a combination of gold and yellow is adopted, a mistake is not recognized if any. In other word, what is seen as gold is an yellow colorant present on an aluminum surface.

In the case where a specific material layer is constituted of a single lamination transfer object, required are:

I) investigation on a desired lamination transfer pattern of a specific material layer and its scope of the transfer;

II) investigation on a scope of ordinary transfer and determination of a color of a transfer underlayer (an ordinary color additionally acts as the transfer underlayer);

Example: In the case where a frame of an image is metallic and letters and the like enclosed by the frame are of an ordinary color (hereinafter referred to as an ordinary color inside metallic), it is recommended that the ordinary color inside metallic plays a roll of precoat. Since FIG. 2(E) is constituted such that part of a circle of the sun located in a area included in the Japanese letter of gold is of an ordinary ink, it is recommended that red and precoat each act double rolls in use.

III) determination of a scope of transfer underlayer transfer;

If an ordinary color and a transfer underlayer are used in a double roll manner, both of the color and layer can simultaneously be transferred with one ribbon in one process. To be simplified, a heating area is a sum of a transfer underlayer transfer are and an ordinary color area.

IV) determination of scopes of a transfer underlayer and an ordinary color other than the same color as that of the layer; and In FIG. 2(E), the pole area is the case.

V) determination of a specific material layer heating scope and determination of a sequence of transfer. The determinations are made through selection on precision, power consumption or the like and therefore, mode setting is required in the determinations. In mode setting, especially of precision in positional displacement, it is recommended that the following items are prepared so as to be dealt with on the apparatus side:

A. the maximal positional displacement with a desired pattern +specifications of the mechanism, B. a half of a distance between the second heating scope and a part with an unnecessary adhesive capability such as a desired pattern +an ordinary transfer section additionally including a transfer underlayer, and C. solid transfer (in the case of no part with an unnecessary adhesive capability, image face-less portion, half tone dots and the like)

These are mutually exchangeable by a software. As mentioned above, energy saving is decreased in the order of A>B>C. Settings on the user side can deal with a range from a simple choice in priority between energy saving and precision to a choice including a technical explanation. Several kinds are ordinarily prepared, though depending on a capability of the host computer.

A lamination transfer object with a specific material layer, a special film, an ink and the like transferred thereon:

I) a special film and a transparent ink are used for the case, wherein a degradation like a rain bow is possible;

As an ordinary ink, a transmissive process color is recommended. For example, conventionally, a lamination transfer object having a trade name of Silver Namer supplied from Lintek Co. has been available, which comprises aluminum vapor-deposited layer with an adhesive layer to an ink thereon, and on which full color metallic printing can be performed by superposition of a process color ink. A problem is that the whole of the transfer target object is metallic and cannot be patterned conventionally. In the present application, a protective layer is a adhesive one in the constitution shown in FIG. 3, a specific material layer on the surface of which an ink can be deposited can be transferred and thereby a full color metallic use film with an arbitrary pattern can be transferred. As mentioned above, an ordinary protective film is non-transferable thereon and has excellent durability, for example. Since the surface of the film in use is easily contaminated, it is preferable that a protective layer is transferred after process color ink transfer if durability is requested.

II) When a specific material layer or an ink is transferred, a transfer underlayer and specific material layer other than in a transfer operation are handled as a part with an unnecessary adhesive capability and each transfer is responded. For example, in such a pattern as shown in FIG. 2(A) in which metallic and an ordinary color are spaced apart from each other, if specific material layers of several kinds comprising red metallic, gold and blue metallic are desired to be transferred for each of the letters of "TEC", all that is required is that FIG. 2(C1) is further divided into respective parts of letters and separately heated. At this point, if FIG. 2(D) of "RESEARCH CENTER" is already transferred, a heating area is selected so as to be displaced from FIG. 2(D) of an ordinary ink as a part with an unnecessary adhesive capability and thereby each desired specific material layer transfer can be carried out while metallic other than this transfer layer is also judged as a part with an unnecessary adhesive capability. That is, even if the Silver Namer type film is mixed in, lamination transfer can be performed giving consideration to positional displacement in advance.

III) If existing layers other than an in-transfer layer in a transfer operation satisfies the relation between forces, transfer can be performed with the same process as in the case of a single transfer.

A protective film provides non-transferability and in a concrete manner, the film is sufficient only if it has no compatibility, has a high melting point or only transparent, transmissive layer is left behind. (In the case where only an adhesive layer is transferred even though the layer is not non-transferable or in the case where allowance is given for the reason that no influence is present on required properties since the layer is achromatic and transparent).

If a transfer target object is back-fed, repetitions can be possible for a transfer underlayer, a specific material layer and ordinary transfer. In this case, an ordinary transfer layer can selectively be transferred on the specific material layer and the object.

For example, after a transfer underlayer A and a specific material layer A are lamination-transferred, a transfer underlayer B and a specific material layer B are lamination-transferred. At this point, while either of the transfer underlayer A and the specific material layer B can be used in a double roll manner, it is required for the object to be back-fed for example. What needs attention is only that lamination transfer on the specific material layer is impossible to be performed because of a protective film on the specific material layer. If a transfer underlayer pattern, which is an underlying layer, is desired to be seen like a half mirror, transfer of a different pattern of the transfer underlayer B (a transfer underlayer having a different optical effect) is performed on the transfer underlayer A and the specific material layer A of a half mirror is superposed on the transfer underlayer B and if still another specific material layer B is necessary, the transfer underlayer B is transferred and the specific material layer B is then lamination-transferred. The transfer underlayer B is printed in an area as a see-through pattern in a half mirror and the transfer underlayer of the specific material layer B or may be printed in a different process. In any way, there is available a user interface such that a transfer result, transfer time and process are known beforehand with the help of the driver. A choice on display or non-display can be made by the user's judgment. Generally these may be a black box.

A heating area and a heating sequence in a lamination transfer process will be described below.

A Transfer Method and the Like

Matters to be attentive when various pattern are actually transferred and ways of how beauty is created will be listed for each desired pattern. A software (driver) to realize the matters and the ways have the following transfer process as an algorithm.

Figure 9:
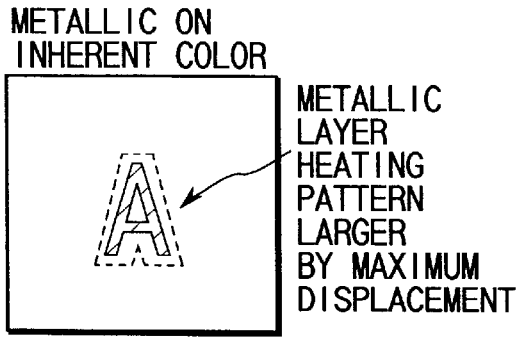
FIGS. 9 to 18 are presentations illustrating various print images having a mixture of an ordinary ink and a metal foil which can be printed by the thermal printer shown in FIG. 1.

Metallic on an Inherent Color of an Object (FIGS. 2 and 9)

A transfer underlayer is transferred in a desired metallic pattern, metallic is heated in a solid manner (an area a little larger than a paper or an area about as large as a desired pattern is included). That is, a metallic use head is allowed not to be an ordinary thermal head.

A transfer underlayer is transferred in a desired metallic pattern and metallic is subjected to a solid heating whose area is a little larger than the pattern. Even if the desired pattern is of half tone dots, heating in a solid mode is applied.

The transfer underlayer may be achromatic. If the layer is achromatic, no conspicuousness arises.

Since the transfer underlayer is to aim for improvement on glossiness of the surface of a paper or the like and durability thereof, the process mentioned above is only required to be applied after solid transfer is performed if the transfer underlayer requires a solid transfer (covering). Since the relation between forces can be realized due to a physical step between a covering and the process, that is the transfer underlayer, rolls of the transfer underlayer and the cover can be played in a double role manner.

Figure 10:
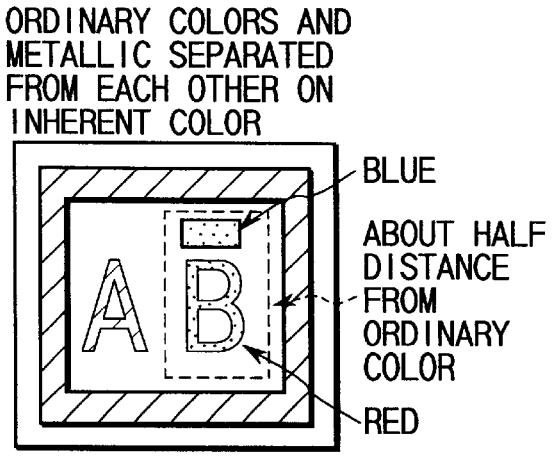

A Plurality of Ordinary Transfers and Metallic on an Inherent Color are Mutually in a Non-contact Relation (FIG. 10)

The ordinary color is transferred in a desired color pattern and then the metallic is transferred in a desired pattern and the metallic is subjected to solid heating in an area a little larger than the desired metallic pattern on a condition of being in non-contact with the ordinary color. At this point, if there is a possibility that the heating area contacts the ordinary color (part with an unnecessary adhesive capability), an ordinary ink with no adhesive capability (an ink with a protective film or the like) is applied to the area.

It is efficient that at least one color among ordinary colors is simultaneously transferred wherein the at least one color is the same as the transfer underlayer (the at least one color acts double roles).

Figure 11:
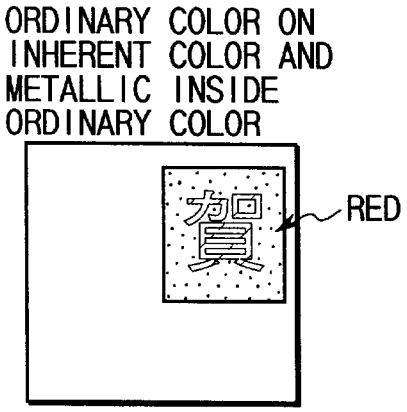
Figure 12:
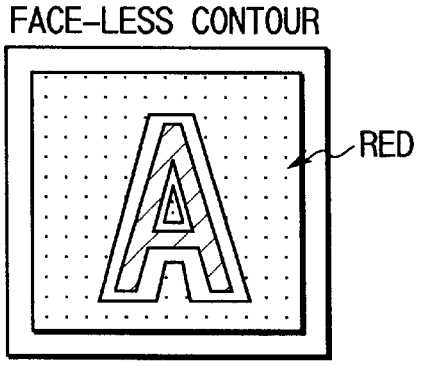

An Ordinary Color on an Inherent color of a Transfer Target Object and Metallic Inside the Ordinary Color (FIGS. 11 and 12)

An ordinary ink is transferred in a desired pattern, a transfer underlayer is transferred in a desired pattern and then the metallic is heated on a desired metallic pattern. Heating may be applied in a solid manner in an area a little larger than the desired metallic pattern in which no contact arises with a part in which expression with an ordinary color is desired (a boundary between the inherent color and the ordinary color). For example, in the case of metallic dots, a transfer underlayer may be subjected to a solid heating, though dots of a dotted pattern are not individually heated.

As an alternate, it is better that an ink and a transfer underlayer are made to be the same and thereby both are simultaneously transferred.

In the case where contact and non-contact portions are desired patterns constituted of a continuous curve or a straight line, since positional displacement is conspicuous if any, it is recommended that the contour of the metallic pattern inside an ordinary color is formed as face-less and left in an inherent color or the transfer underlayer is provided with a physical step while superposing an ordinary color, whereby non-contact condition is substantially brought in.

Figure 13:
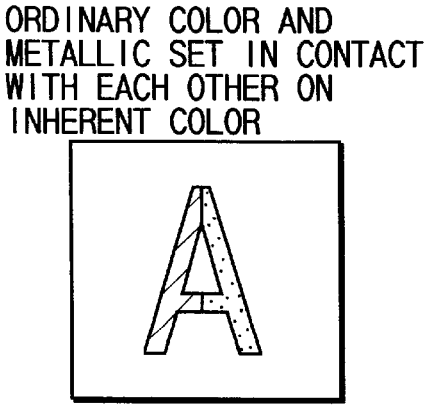

An Ordinary Color and Metallic are Adjacent to Each Other on an Inherent Color and a Boundary Between the Ordinary Color and the Inherent Color is Continuous with a Boundary Between the Metallic and the Inherent Color (FIG. 13)

An ordinary ink is transferred in a desired pattern, a transfer underlayer is transferred in a desired metallic pattern, a part of the metallic which abuts on the ordinary ink is heated in the desired metallic pattern and in the boundary with the inherent color, a little larger portion beyond the boundary is subjected to a solid heating.

Figure 14:
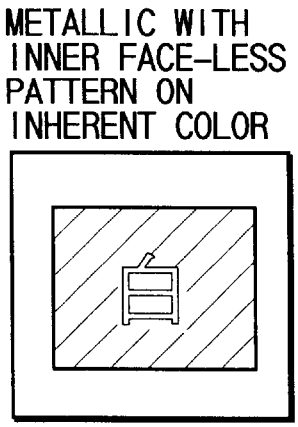
Figure 15:
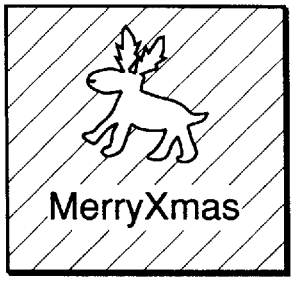

Image-faceless Printing of Metallic with Use of the Metallic as a Solid Inherent Color or Application of Image-faceless Patterning on a Solid Metallic (FIGS. 14 and 15)

Figure 16:
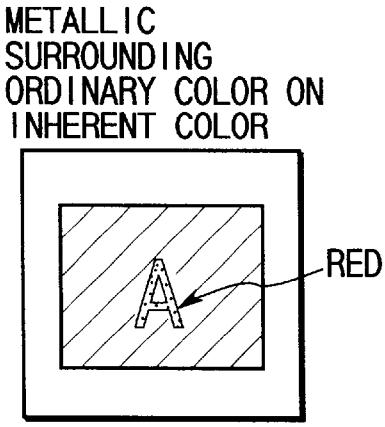

When the inherent color is white, a transfer underlayer is transferred in a desired metallic image-faceless pattern, and the metallic is subjected to solid heating or heating in a pattern a little larger than the desired pattern and an image face-less area is heated in a face-less pattern a little smaller than the desired pattern Metallic with an Ordinary Pattern Inside on an Inherent Color (FIG. 16)

When the inherent color is a desired color (an ordinary color), metallic as a transfer underlayer is transferred in an image-faceless pattern so that the faceless portion may be a desired ordinary color pattern, and the outside of the metallic is subjected to heating in a pattern a little larger than the desired pattern along the boundary with the inherent color and an image face-less area is heated in a face-less pattern a little smaller than the desired face-less pattern.

When an inherent color and a desired color are different, it is recommended that an ordinary ink, a first ink and then metallic are sequentially transferred in the order, and it is also recommended that the ordinary ink is transferred in a pattern a little larger than a desired pattern, subsequently the transfer underlayer is transferred in a desired metallic pattern, the inside of the metallic is heated in a face-less pattern a little smaller than the desired area and the outside of the metallic is heated in a pattern a little larger than the desired pattern along the boundary with the inherent color. It is also possible that the metallic can be heated in a solid manner though a heating condition is dependent on the presence of a step or an adhesive force to the ordinary ink.

When the ordinary ink and a transfer underlayer is the same, transfer of the ordinary ink is carried out so that an area of transfer may be one of combination of a desired ordinary color pattern and a metallic pattern (sum of a logical operation). The metallic is subjected to heating in the desired metallic pattern in an area where the metallic pattern corresponds to the ordinary ink pattern and in a pattern a little larger than the desired metallic pattern at a boundary with the inherent color.

Figure 17:
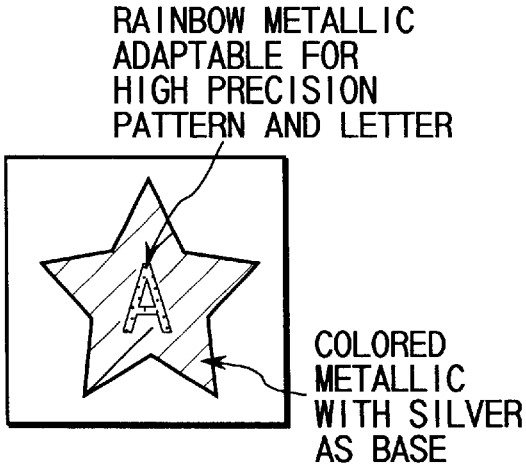

A Colored Metallic (Multi-colored Metallic is Possible) with Silver as a Base (FIG. 17)

When a transfer target object is made of a metallic use material, silver (an alternative of the Silver Namer) with an achromatic, transparent material layer (selective adhesive function) of an ordinary ink-use material thereon is heat-transferred in an area which is an equivalent to a desired pattern (an area of a disjunction in the multi-color case) and thus a desired pattern of a desired transmissive color (yellow for gold, blue for blue metallic and the like) is lamination-transferred.

As an alternate, a transfer underlayer is simultaneously lamination-transferred on a transfer target object having the surface prepared so as to accept metallic.

A glossiness of metallic is better in the case with a larger thickness but such thick metallic conventionally cannot have a fine pattern. In this embodiment, a combination of multi-color metallic and intermediate tone metallic, and a high resolution are mutually compatible (as an comparative example, a hot stamping sample from Yamadai Bisho Co., as mentioned above, since a heat capacity of a die is too large and a heat/press time is long, a high resolution cannot be achieved, even though a metal thickness is adjusted small).

Figure 18:
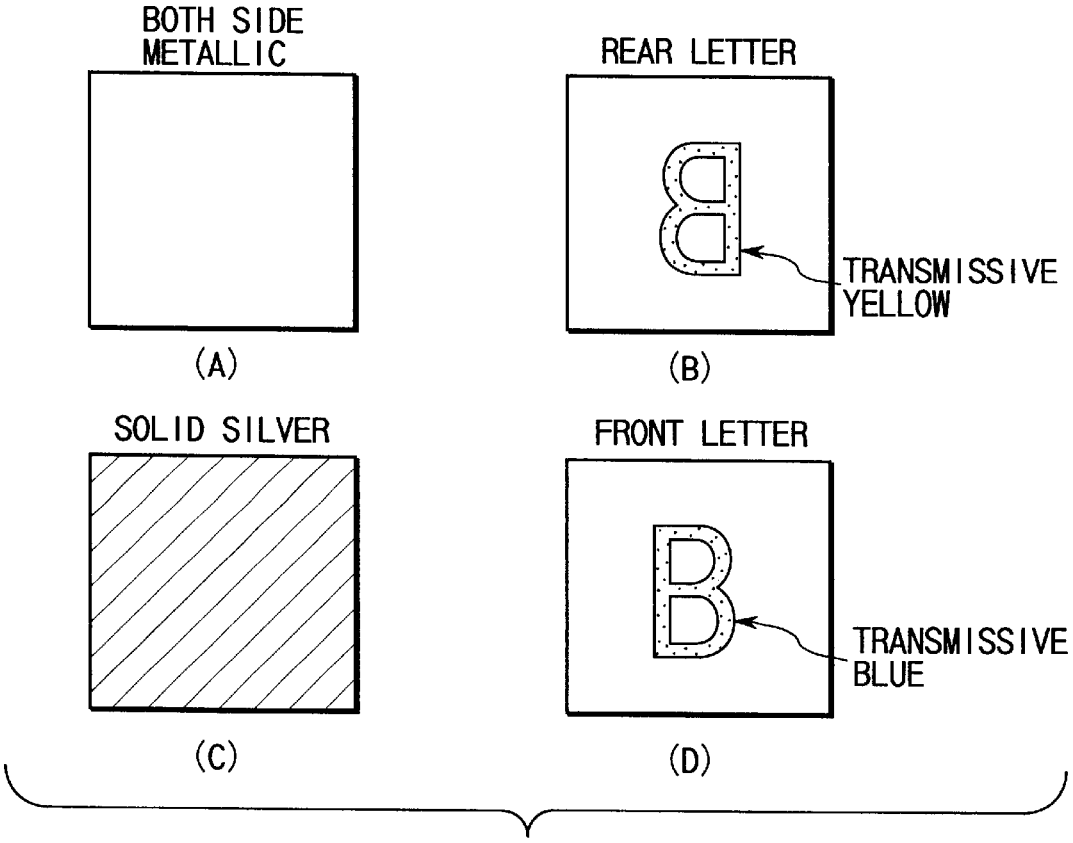
Figure 19:
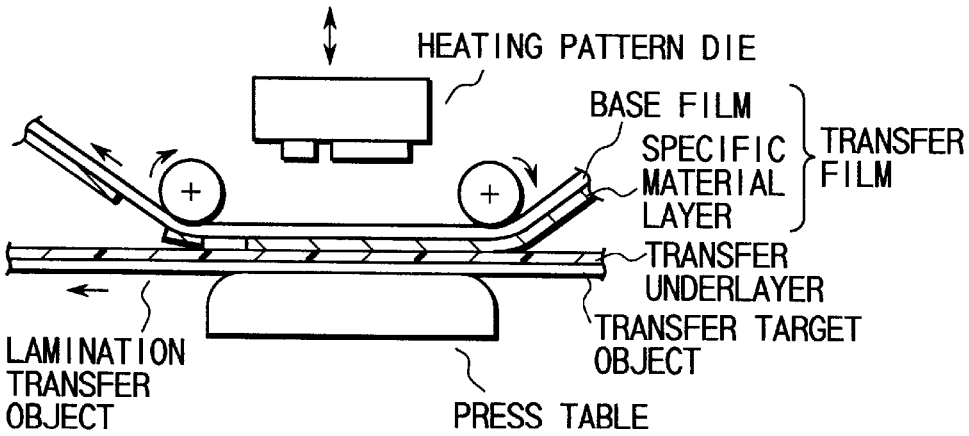
FIG. 19 (PRIOR ART)
FIG. 19 is a presentation for illustrating hot stamping performed in a conventional up/down transfer machine.

Both Side of Metallic (in Use for a Window Display) (FIG. 18)

When a transfer target object is to be made of a material which is adjusted in use for not only metallic but an ordinary ink, the object is selected to be an achromatic transparent sheet such as vinyl chloride (generally available as a seal), a transfer underlayer is transferred with a rear side surface of a desired transparent color (yellow for gold, blue for blue metallic) and a rear side surface of a desired pattern (a mirror symmetrical pattern), metallic of silver is heat-transferred in a solid heating and an ordinary ink of a desired transparent color is transferred with a desired front pattern.

When white and black bases are fabricated using inks of a low transmittance, an ink of an inherent color is transferred with a pattern which is an equivalent to or a little larger than a desired metallic rear side surface pattern before silver in the process is subjected to solid heating, then silver is subjected to solid heating and thereafter an ink of an inherent color is transferred with a pattern which is an equivalent to or a little larger than a desired metallic front side surface pattern, whereby a part of both side of metallic can be obtained as a white base.

When a Head Width is Oversized (FIG. 2(C))

With a serial printer in use, if transfer is carried out at a width larger than a print head, a connecting portion arises and a gap is made to be conspicuous due to the connecting portion. The reason why is that a superposing portion is higher in density.

Therefore, in the case of metallic, since it is small in transmittance, a gap is easy to draw attention, whereas superposition does not have much of a chance to arise and metallic ink is hard to stick on metallic, which is preferably utilized in heat-transfer in a superposing manner. A superposing portion is not eventually lamination-transferred. If the superposing portion was transferred, it would not be conspicuous so much.

In the cases of a logo and a mark, it is recommended that a connecting portion is not superposed on a specific material layer or it is preferred that the superposition is as small as possible.

Special Films (Hologram and Transmissive Metallic are also Possible)

As a lamination transfer object which has conventionally required a die, metallic of a transmissive type such as hologram and a half mirror is named and these do not require a die any more according to the present application. Metallic of a zebra pattern or a tiger pattern and a film having a company name can be used. A light diffusion film (reflecting plate) can also be used. A film with a ceramic film (protection, surface modification and appearance modification) can also be used.

If an ink of a transmissive type is desired to be used, obtained is a lamination transfer object with special functions in which a previously transferred pattern or color such as a transfer underlayer can be seen-through and the lamination transfer object has a glossiness and is added, as optical functions, with optical phenomena utilizing hologram or diffraction (an image changes based on a direction along which direction the image is seen). Comparative examples are a press-blanking samples, an Ohsaka sealing (a seal for children and the like).

How to Determine a Transfer Heating Range for a Transfer Underlayer and Specific Material Layer Described will be a way in which a user fabricates a desired pattern (image) with use of an application program and a way in which it is judged or determined by a driver how which transfer film should be transferred or heated.

A Transfer Scope and a Process

Though the methods are used so that no positional displacement is brought about, the transfer scope and process are determined so that a positional displacement falls within the maximal positional displacement even in the worst case.

In a boundary with a non-adhesive scope, only the maximal displacement is set larger, or it is set so as to be a half of a distance from a transfer underlayer or a previously transferred ink (an ink whose adhesion draws attention even when the ink does not play an additional roll of the transfer underlayer, and metallic is unevenly transferred thereon). As has been described, while there is an ink which is eventually transferred in a solid manner based on a disjunction, it is determined that some of the above mentioned inks should be transferred in a solid manner, according to their patterns. In the examples as has been described heretofore in the application, the process is one which is judged to be operated in conditions in which the inks do not adhere to all the parts other than a metal part. A part of judging conditions will be described.

An ordinary color and a transfer underlayer is the same (used in a double role manner): in the case, an ordinary color area is judged as an unnecessary adhesive portion.

An ordinary color inside metallic and a transfer underlayer is the same: in the case, an ordinary color area is judged as an unnecessary adhesive portion.

Ordinary colors each have a selective adhesive function: in the case, an ordinary color area is judged as an unnecessary adhesive portion.

Judgment is performed based on the above mentioned conditions and order.

Since these are conditions in which the number of process steps can be decreased if the process can be performed in a double role manner, as a precondition, inks for replacement owned by a user are confirmed together with others available and a series of transfer process steps are carried out while recommending the user exchange of inks.

First of all, a scope of a transfer underlayer is judged and an ink which works as an ordinary ink in addition to a transfer underlayer and scopes of the ordinary ink is determined and the transfer underlayer are then determined. Subsequently, determined is a scope of ordinary colors other than the ordinary ink and a metallic scope is judged and determined.

In the case where a plurality of metallic transfers are conducted and when the transfers cannot be performed by the multi-color transfer mentioned above, a portion which can be performed and the other which cannot be performed are divided as separate scopes. A way to dividing is to determine scopes based on whether or not metallic is transferred on metallic, or how an adhesive force between a transfer underlayer and a transfer target object is affected by a step or the like.

Pattern cases as mentioned above are stored in the driver and the user may display the patterns as a reference pattern when the user forms an image. Besides, it is good to display recommendable inks and films which are necessary for the patterns at the same time. All that is necessary are determined based on the relation between forces and what is transferable on which ?, what is absolutely not transferable on which ? and what is an unstable transfer ? and the like are stored in a table and thereby they can automatically be printed out based on conditions of combinations of a transfer object, an ink, a transfer film for a specific material layer and transfer underlayer, a speed and the like, only if information on articles of consumption owned by the user are available.

As mentioned above, according to the present invention, a film made of a metal or the like can, in an on-demand mode, be lamination-transferred on a transfer target object under heat and pressure in an arbitrary shape without a die nor a form plate to obtain the object laminated with a metal foil or the like and a lamination transfer machine can be operated without learning a special technique.

In addition to this, obtainable is a desired pattern with no positional displacement between a transfer underlayer and a specific material layer and with high precision.

Besides, a special film such as a resin based ink can be lamination-transferred on a transfer target object such as a rough paper or a plain paper, which has conventionally been impossible to be used as an object, and the lamination transfer object, which has a good appearance, and which has no trace of a transfer underlayer, can be achieved. Since there is no need for specially storing a transfer film ribbon for the transfer underlayer, there can be obtained a lamination transfer object with a specific material layer which is excellent in abrasion resistance, light resistance, chemical resistance or the like on a transfer object with a rough surface at a low cost.

As a special film, almost every material can be used if it can be formed as a thin film, there can be used a film which has a metallic glossiness or conductivity, is inorganic, is mat, is of an insulating property, is wear resistant, or is highly frictional or abrasive (sand paper), or made of an abrasive film (sand paper) with high abrasion resistance and the film can contain, at least as a part, an optical effect film such as a reflecting film, a half reflecting film, a half transmissive film, a transmissive film, a non-transmissive film, a refractive film, a diffraction film, a scattering film or the like and thereby a lamination transfer object can be provided with a decorative effect, an optical effect and an electromagnetic effect.

A film in which an arbitrary color including a plurality of colors and an intermediate tone can be added to an optical effect such as glossiness can be transferred in an arbitrary pattern.

A film originally with a pattern such as a trade mark, half tone dots, grating or the like, that is a film with a pattern characterized by a desired fineness can be transferred in an arbitrary pattern. Besides, the above mentioned film patterns can be fabricated from a film of a desired material quality.

With a transfer underlayer and a specific material layer in use, there can be fabricated an optical component in the shape of a film, or optical circuitry and/or an electromagnetic circuitry.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A lamination transfer object producing apparatus comprising:

a variable area heating unit for applying heat with pressure to a transfer film having a specific material layer, arranged to cover a transfer underlayer of a desired pattern formed on a transfer target object, and removed to transfer said specific material layer toward said transfer target object; and a controller for controlling said variable area heating unit such that said transfer film is heated with a heating pattern larger than the pattern of said transfer underlayer by at least a margin for positional displacement between said transfer underlayer and said variable area heating unit, so as to obtain a lamination transfer object in which a contour of said specific material layer is aligned with that of said transfer underlayer by an adhesive force between said specific material layer and said transfer underlayer.

2. A lamination transfer object producing method comprising:

a step of applying heat with pressure by a variable area heating unit to a transfer film having a specific material layer, arranged to cover a transfer underlayer of a desired pattern formed on a transfer target object, and removed to transfer said specific material layer toward said transfer target object; and a step of controlling said variable area heating unit such that said transfer film is heated with a heating pattern larger than the pattern of said transfer underlayer by at least a margin for positional displacement between said transfer underlayer and said variable area heating unit, so as to obtain a lamination transfer object in which a contour of said specific material layer is aligned with that of said transfer underlayer by an adhesive force between said specific material layer and said transfer underlayer.

3. A lamination transfer object producing apparatus according to claim 1, wherein said specific material layer is made of a material which can be heat-transferred on said transfer underlayer in a transfer condition of a heating energy lower than that required for transferring on said transfer target object.

4. A lamination transfer object producing apparatus according to claim 1, wherein said specific material layer is made of a material which can be heat-transferred on said transfer underlayer and cannot be heat-transferred to said transfer target object in a transfer condition of a heating energy identical to that required for transferring on said transfer underlayer.

5. A lamination transfer object producing apparatus according to claim 1, wherein:

said transfer target object, said transfer underlayer, and said specific material layer are made of materials which can obtain a relationship that an adhesive force between a base of said transfer film and said specific material layer and a retaining force of said specific material layer itself are larger than an adhesive force between said specific material layer and said transfer target object in an area where said transfer underlayer is not present at a time of applying heat and pressure to said transfer film and a time of separation, a relationship that the retaining force of said specific material layer itself, an adhesive force between said specific material layer and said transfer underlayer, a retaining force of said transfer underlayer itself, an adhesive force between said transfer underlayer and the transfer target object and a retaining force of said transfer target object itself are larger than the adhesive force between the base of said transfer film and said specific material layer in an area where said transfer underlayer is present at the heat and pressure applying time, and a relationship that the adhesive force between said specific material layer and said transfer underlayer and the retaining force of said specific material layer itself are larger than the adhesive force between the base of said transfer film and said specific material layer in the area where said transfer underlayer is present at the separating time.

6. A lamination transfer object producing apparatus according to claim 1, wherein said transfer underlayer is made of a wax based, wax resin based or resin based thermally fusible ink that is achromatic or colored.

7. A lamination transfer object producing apparatus according to claim 1, wherein said transfer film is constituted by at least a base, a separation layer, the specific material layer and an adhesive layer which can adhere to said transfer underlayer by heat.

8. A lamination transfer producing object apparatus according to claim 1, wherein said specific material layer contains a metal.

9. A lamination transfer object producing apparatus according to claim 1, wherein said specific material layer contains a ceramic.

10. A lamination transfer object producing apparatus according to claim 1, wherein said specific material layer contains a thin film at least as a part thereof.

11. A lamination transfer object producing apparatus according to claim 1, wherein said specific material layer contains an optical effect film, said optical effect film comprising at least one of a reflecting film, a half reflecting film, a half transmissive film, a transmissive film, a non-transmissive film, a refractive film, a diffraction film, a scattering film or the like at least as a part thereof.

12. A lamination transfer object producing apparatus according to claim 1, wherein at least one of said specific material layer and said transfer underlayer contains at least one of thermosetting resin and thermoplastic resin.

13. A lamination transfer object producing apparatus according to claim 1, wherein said specific material layer contains an electromagnetic function film at least as a part thereof.

14. A lamination transfer object producing apparatus according to claim 1, wherein said transfer underlayer is formed of a plurality of thermally fusible ink layers.

15. A lamination transfer object producing apparatus according to claim 1, wherein:

another layer is formed next to said transfer underlayer and exposed on said transfer target object, and the heating pattern for said transfer film is determined not to overlap said other layer.

16. A lamination transfer object producing apparatus according to claim 1, wherein the heating pattern for said transfer film is determined to cover said transfer underlayer except for part to be exposed, so as to obtain a desired symbol by a combination of said specific material layer and said transfer underlayer.

17. A lamination transfer object producing apparatus according to claim 1, wherein:

another transfer underlayer of a desired pattern is formed on a transfer target object, and the heating pattern for said transfer film is determined not to overlap said other transfer underlayer so as to obtain a desired symbol by said other transfer underlayer.

18. A lamination transfer object producing apparatus according to claim 1, wherein said specific material layer has a selective adhesion property to said transfer underlayer and a layer other than said transfer underlayer.

19. A lamination transfer object producing apparatus according to claim 18, wherein:

the specific material layer comprises an optical effect film, and said other layer is of a transmissive process color ink.

20. A lamination transfer object producing apparatus according to claim 19, wherein said optical effect film comprises a reflecting film.

21. A lamination transfer object producing apparatus according to claim 1, wherein at least one of said transfer underlayer and said specific material layer has a non-transfer property for another layer at least as a part thereof.

22. A lamination transfer object producing apparatus according to claim 1, wherein said specific material layer has a pattern formed in advance on said transfer film to obtain a desired symbol.

23. A lamination transfer object producing apparatus according to claim 1, wherein said specific material layer has a pattern formed in advance on said transfer film to obtain a desired blank symbol.

24. A lamination transfer object producing apparatus according to claim 1, wherein said lamination transfer object serves as one of an optical component, an optical circuitry, an electromagnetic component and an electromagnetic circuitry.

25. A lamination transfer object producing apparatus according to claim 1, wherein said transfer underlayer and said specific material layer serve as one of an optical component, an optical circuitry, an electromagnetic component and an electromagnetic circuitry.

26. A lamination transfer object producing apparatus according to claim 1, wherein said controller is arranged such that said transfer underlayer is heat-transferred in addition to said specific material layer by said variable area heating unit, and a heating pattern for said transfer underlayer is determined on the basis of information concerning a type and a pattern of said specific material layer.

27. A lamination transfer object producing apparatus according to claim 25, wherein:

said variable area heating unit includes one of a thermal head, a heater, and an energy-beam irradiating device, said transfer underlayer is made of a material which can be heat-transferred on another layer formed in advance on said transfer target object, and said controller is arranged such that said transfer underlayer and said specific material layer are heat-transferred in at least one of a hot separation scheme and a cold separation scheme.

28. A lamination transfer object producing apparatus according to claim 1, wherein at least parts of said transfer underlayer and said specific material layer are compatible with each other.

29. A lamination transfer object producing apparatus according to claim 1, wherein the heating pattern for said transfer film has a contour corresponding to that of said transfer underlayer at least as a part thereof.

30. A lamination transfer object producing apparatus according to claim 1, wherein the heating pattern for said transfer film is determined to extend within about half of a distance between said transfer underlayer and another layer located next to said transfer underlayer.

31. A lamination transfer object producing apparatus according to claim 16, wherein said heating pattern for said transfer film is determined to extend outside said transfer underlayer.

32. A lamination transfer object producing apparatus according to claim 1, wherein said transfer target object is made of a transparent material, and another layer is formed on a rear side surface of said transfer target object in a pattern mirror symmetrical to that of said transfer underlayer.

33. A method according to claim 2, wherein said specific material layer is made of a material which can be heat-transferred on said transfer underlayer in a transfer condition of a heating energy lower than that required for transferring on said transfer target object.

34. A method according to claim 2, wherein said specific material layer is made of a material which can be heat-transferred on said transfer underlayer and cannot be heat-transferred to said transfer target object in a transfer condition of a heating energy identical to that required for transferring on said transfer underlayer.

35. A method according to claim 2, wherein said transfer target object, said transfer underlayer, and said specific material layer are made of materials which can obtain a relationship that an adhesive force between a base of said transfer film and said specific material layer and a retaining force of said specific material layer itself are larger than an adhesive force between said specific material layer and said transfer target object in an area where said transfer underlayer is not present at a time of applying heat and pressure to said transfer film and a time of separation, a relationship that the retaining force of said specific material layer itself, an adhesive force between said specific material layer and said transfer underlayer, a retaining force of said transfer underlayer itself, an adhesive force between said transfer underlayer and the transfer target object and a retaining force of said transfer target object itself are larger then the adhesive force between the base of said transfer film and said specific material layer in an area where said transfer underlayer is present at the heat and pressure applying time, and a relationship that the adhesive force between said specific material layer and said transfer underlayer and the retaining force of said specific material layer itself are larger than the adhesive force between the base of said transfer film and said specific material layer in the area where said transfer underlayer is present at the separation time.

36. A method according to claim 2, wherein.

another layer is formed next to said transfer underlayer and exposed on said transfer target object, and said controlling step includes a substep of determining the heating pattern for said transfer film not to overlap said other layer.

37. A method according to claim 2, wherein said controlling step includes a substep of determining the heating pattern for said transfer film to cover said transfer underlayer except for part to be exposed, so as to obtain a desired symbol by a combination of said specific material layer and said transfer underlayer.

38. A method according to claim 2, wherein:

another transfer underlayer of a desired pattern is formed on a transfer target object, and said controlling step includes a substep of determining the heating pattern for said transfer film not to overlap said other transfer underlayer, so as to obtain a desired symbol by said other transfer underlayer.

39. A method according to claim 2, wherein said transfer underlayer is heat-transferred in addition to said specific material layer by said variable area heating unit, and said controlling step includes a substep of determining a heating pattern for said transfer underlayer on the basis of information concerning a type and a pattern of said specific material layer.

40. A method according to claim 2, wherein said controlling step includes a substep of determining the heating pattern for said transfer film to extend within about half of a distance between said transfer underlayer and another layer located next to said transfer underlayer.

41. A method according to claim 37, wherein said controlling step includes a substep of determining said heating pattern for said transfer film to extend outside said transfer underlayer.

* * * * *